US010359063B2

(12) United States Patent
Shan et al.

(10) Patent No.: US 10,359,063 B2
(45) Date of Patent: Jul. 23, 2019

(54) METHOD AND SYSTEM FOR RECOVERING AND UTILIZING OPERATING ENERGY OF CRANE, AND CRANE

(71) Applicant: XUZHOU HEAVY MACHINERY CO., LTD., Xuzhou, Jiangsu Province (CN)

(72) Inventors: Zenghai Shan, Xuzhou (CN); Zhengde Zhang, Xuzhou (CN); Xiaodong Hu, Xuzhou (CN); Haiyan Zhang, Xuzhou (CN); Conglin Yuan, Xuzhou (CN)

(73) Assignee: Xuzhou Heavy Machinery Co.., Ltd., Xuzhou (CN)

( * ) Notice: Subject to any disclaimer, the term of this patent is extended or adjusted under 35 U.S.C. 154(b) by 182 days.

(21) Appl. No.: 15/528,649

(22) PCT Filed: Jan. 19, 2015

(86) PCT No.: PCT/CN2015/070962

§ 371 (c)(1),
(2) Date: May 22, 2017

(87) PCT Pub. No.: WO2016/082321

PCT Pub. Date: Jun. 2, 2016

(65) Prior Publication Data

US 2017/0268541 A1 Sep. 21, 2017

(30) Foreign Application Priority Data

Nov. 24, 2014 (CN) ..... 2014 1 0680034
Nov. 24, 2014 (CN) ..... 2014 1 0683575

(51) Int. Cl.
*F15B 21/14* (2006.01)
*F15B 1/02* (2006.01)
(Continued)

(52) U.S. Cl.
CPC ..... *F15B 21/14* (2013.01); *B66C 13/12* (2013.01); *B66C 13/20* (2013.01); *B66D 1/44* (2013.01); *F15B 1/024* (2013.01)

(58) Field of Classification Search
CPC ..... F15B 1/024; F15B 21/14
(Continued)

(56) References Cited

U.S. PATENT DOCUMENTS 4,686,828 A * 8/1987 Rosman ..... B66D 1/08 212/250
8,109,085 B2 * 2/2012 McBride ..... F15B 1/024 60/412
(Continued)

FOREIGN PATENT DOCUMENTS

CN 101070864 11/2007
CN 101230871 7/2008
(Continued)

OTHER PUBLICATIONS

Extended European Search Report for corresponding EP application No. 15862593 dated Aug. 6, 2018, 7 pages.
(Continued)

*Primary Examiner* — Michael Leslie
(74) *Attorney, Agent, or Firm* — Myers Bigel, P.A.

(57) ABSTRACT

A method and a system for recovering and utilizing crane operating energy and a crane includes converting by a first hydraulic power means hydraulic energy generated by a hydraulic actuator into mechanical energy of a transmission shaft; driving, by the transmission shaft, a second hydraulic power means to rotate so as to convert the mechanical energy of the transmission shaft into mechanical energy of the second hydraulic power means; filling, by the second hydraulic power means, pressurized oil into an accumulator
(Continued)

so as to convert the mechanical energy of the second hydraulic power means into hydraulic energy for storage.

15 Claims, 9 Drawing Sheets

(51) Int. Cl.
*B66C 13/12* (2006.01)
*B66C 13/20* (2006.01)
*B66D 1/44* (2006.01)

(58) Field of Classification Search
USPC ..... 60/414
See application file for complete search history.

(56) References Cited

U.S. PATENT DOCUMENTS

| | | | | |
|---|---|---|---|---|
| 8,151,563 | B2 | 4/2012 | Schneider et al. | |
| 9,963,855 | B2 * | 5/2018 | Jagoda | B60K 6/12 |
| 10,145,396 | B2 * | 12/2018 | Du | F15B 21/14 |
| 10,167,613 | B2 * | 1/2019 | Kondo | F15B 21/14 |
| 2012/0160796 | A1 | 6/2012 | Weckbecker et al. | |
| 2013/0133966 | A1 | 5/2013 | Jiang et al. | |
| 2017/0009428 | A1 * | 1/2017 | Hijikata | F15B 21/14 |
| 2017/0198731 | A1 * | 7/2017 | Sugano | F15B 21/14 |
| 2018/0051720 | A1 * | 2/2018 | Hijikata | E02F 9/2217 |

FOREIGN PATENT DOCUMENTS

| | | |
|---|---|---|
| CN | 101398017 | 4/2009 |
| CN | 101846121 | 9/2010 |
| CN | 201679802 | 12/2010 |
| CN | 102241379 | 11/2011 |
| CN | 102606549 | 7/2012 |
| CN | 103470544 | 12/2013 |
| CN | 103626057 | 3/2014 |
| CN | 103671365 | 3/2014 |
| CN | 103896156 | 7/2014 |
| CN | 203833526 | 9/2014 |
| GB | 2485570 | 5/2012 |
| JP | 2003269404 | 9/2003 |
| JP | 2006322578 | 11/2006 |
| JP | 2009292553 | 12/2009 |
| JP | 2014020417 | 2/2014 |

OTHER PUBLICATIONS

International Search Report for PCT/CN2015/070962 dated May 19, 2015 with translation, 9 pages.
Office Action for Chinese Patent Application No. 201410683575.8 dated Dec. 27, 2016, 7 pages.
Office Action for Chinese Patent Application No. 201410680034.X dated Sep. 30, 2016, 7 pages.

* cited by examiner

METHOD AND SYSTEM FOR RECOVERING AND UTILIZING OPERATING ENERGY OF CRANE, AND CRANE

RELATED APPLICATIONS

The present application is a 35 U.S.C. § 371 national phase application of PCT International Application No. PCT/CN2015/070962, filed Jan. 19, 2015, which claims priority to Chinese Patent Application No. 20141068003.X filed Nov. 24, 2014, and Chinese Patent Application No. 201410683575.8 filed Nov. 24, 2014, the disclosures of which are hereby incorporated herein by reference in their entireties.

TECHNICAL FIELD

The present invention relates to the field of mechanical engineering, and in particular to a method and a system for recovering and utilizing crane operating energy as well as a crane.

BACKGROUND ART

A crane is a gravity working machine, a hydraulic actuator of the crane producing a large amount of energy in a lowering or braking process, for example, existing crane products usually producing a large amount of gravitational potential energy in winching and derricking lowering processes.

In the related art, in the winching and derricking lowering processes, the speed of winching and derricking lowering is adjusted by controlling the area of an orifice of a balance valve, such that all the energy generated in a lowering process of a load is converted into thermal energy, resulting in a waste of energy and a rise of the hydraulic oil temperature and reducing reliability of hydraulic components. Moreover, in order to reduce the rise of oil temperature, it is also necessary to increase the heat dissipated power of a radiator, causing an increase in the cost of design.

SUMMARY OF THE INVENTION

In regard of the above technical problem, the present invention provides a method and a system for recovering and utilizing crane operating energy, and a crane, which achieve the purposes of saving energy, reducing emission and reducing the amount of heat generated by the system via a hydraulic actuator for recovering and utilizing the energy released during the lowering process.

According to one aspect of the invention, a method of recovering and utilizing crane operating energy is provided, said method comprising:

converting, by a first hydraulic power means, hydraulic energy generated by a hydraulic actuator into mechanical energy of a transmission shaft;

driving, by the transmission shaft, a second hydraulic power means to rotate so as to convert the mechanical energy of the transmission shaft into mechanical energy of the second hydraulic power means;

filling, by the second hydraulic power means, pressurized oil into an accumulator so as to convert the mechanical energy of the second hydraulic power means into hydraulic energy for storage.

In one embodiment of the present invention, the hydraulic actuator includes a derricking cylinder;

wherein the step of converting, by the first hydraulic power means, hydraulic energy generated by the hydraulic actuator into mechanical energy of the transmission shaft comprises:

converting, by the derricking cylinder, gravitational potential energy generated during derricking lowering of a crane arm into hydraulic energy;

converting, by the first hydraulic power means, the hydraulic energy generated by the derricking cylinder into mechanical energy of the transmission shaft.

In one embodiment of the present invention, wherein the hydraulic actuator includes a winch motor;

wherein the step of converting, by the first hydraulic power means, hydraulic energy generated by the hydraulic actuator into mechanical energy of the transmission shaft comprises:

converting, by the winch motor, gravitational potential energy generated by a load of the crane in a lowering process of the load into hydraulic energy;

converting, by the first hydraulic power means, the hydraulic energy generated by the winch motor into mechanical energy of the transmission shaft.

In one embodiment of the present invention, in the process of driving, by the transmission shaft, the second hydraulic power means to rotate so as to convert the mechanical energy of the transmission shaft into mechanical energy of the second hydraulic power means, further comprising:

acquiring, in real time, a load torque $T_h$ output by the first hydraulic power means to a transfer case, wherein an engine and the second hydraulic power means are connected to the first hydraulic power means via the transfer case;

acquiring a maximum recovery torque $T_{x_{max}}$ of the second hydraulic power means;

judging whether or not $T_{x_{max}}$ is less than $T_h$;

maximizing a displacement of the second hydraulic power means such that a recovery torque of the second hydraulic means $T_x=T_{x_{max}}$, and balancing $T_h$ by $T_x$ in cooperation with a braking torque of the engine, if $T_{x_{max}}$ is less than $T_h$;

adjusting the displacement of the second hydraulic power means, such that the recovery torque of the second hydraulic means $T_x=T_h$, if $T_{x_{max}}$ is no less than $T_h$.

In one embodiment of the present invention, the method further comprises:

converting, by the second hydraulic power means, the hydraulic energy released by the accumulator into mechanical energy of the transmission shaft when the crane needs energy to drive the hydraulic actuator to perform an operation;

converting, by a main pump, the mechanical energy of the transmission shaft into hydraulic energy in order to drive the hydraulic actuator to perform a corresponding operation.

In one embodiment, the hydraulic actuator includes a derricking cylinder;

wherein the step of converting, by the main pump, the mechanical energy of the transmission shaft into hydraulic energy in order to drive the hydraulic actuator to perform the corresponding operation includes:

converting, by the main pump, the mechanical energy of the transmission shaft into hydraulic energy in order to drive the derricking cylinder to implement derricking lifting of the crane arm.

In one embodiment of the present invention, the hydraulic actuator includes a winch motor;

wherein the step of converting, by the main pump, the mechanical energy of the transmission shaft into hydraulic energy in order to drive the hydraulic actuator to perform the corresponding operation includes:

converting, by the main pump, the mechanical energy of the transmission shaft into hydraulic energy in order to drive the winch motor to implement winching lifting of the load.

In one embodiment of the present invention, in the process of converting, by the second hydraulic power means, the hydraulic energy released by the accumulator into mechanical energy of the transmission shaft, further comprising:

acquiring, in real time, a load torque $T_d$ output by the main pump;

acquiring a maximum driving torque $T_{xc_{max}}$ that can be provided by the second hydraulic power means;

judging whether or not $T_{xc_{max}}$ is less than $T_d$;

maximizing the displacement of the second hydraulic power means, such that a driving torque provided by the second hydraulic power means $T_{xc}=T_{xc_{max}}$, and driving the main pump by $T_{xc}$ in cooperation with the driving torque of the engine, if $T_{xc_{max}}$ is less than $T_d$;

adjusting the displacement of the second hydraulic power means, such that the driving torque provided by the second hydraulic power means $T_{xc}=T_d$, if $T_{xc_{max}}$ is no less than $T_d$.

According to another aspect of the present invention, a system for recovering and utilizing crane operating energy is provided, said system comprising: a hydraulic actuator for generating hydraulic energy;

a first hydraulic power means;

a transmission shaft;

a second hydraulic power means; and an accumulator for storing hydraulic energy, wherein the first hydraulic power means converts the hydraulic energy generated by the hydraulic actuator into mechanical energy of the transmission shaft;

the transmission shaft drives the second hydraulic power means to rotate so as to convert the mechanical energy of the transmission shaft into mechanical energy of the second hydraulic power means;

the second hydraulic power means fills pressurized oil into the accumulator so as to convert the mechanical energy of the second hydraulic power means into hydraulic energy for storage.

In one embodiment of the present invention, the hydraulic actuator includes a derricking cylinder for converting gravitational potential energy generated during derricking lowering of the crane arm into hydraulic energy;

the first hydraulic power means converts the hydraulic energy generated by the derricking cylinder into mechanical energy of the transmission shaft.

In one embodiment of the present invention, the hydraulic actuator includes a winch motor for converting gravitational potential energy generated by a load of the crane in a lowering process of the load into hydraulic energy;

the first hydraulic power means converts the hydraulic energy generated by the winch motor into mechanical energy of the transmission shaft.

In one embodiment of the present invention, an engine and the second hydraulic power means are connected to the first hydraulic power means via a transfer case;

the system further includes:

a first torque acquisition module for acquiring, in real time, a load torque $T_h$ output by the first hydraulic power means to the transfer case in the process that the transmission shaft drives the second hydraulic power means to rotate so as to convert the mechanical energy of the transmission shaft into mechanical energy of the second hydraulic power means;

a second torque acquisition module for acquiring a maximum recovery torque $T_{x_{max}}$ of the second hydraulic power means in the process that the second hydraulic power means converts the hydraulic energy released by the accumulator into mechanical energy of the transmission shaft;

a first discrimination module for judging whether or not $T_{x_{max}}$ is less than $T_h$;

a second displacement adjustment module for maximizing the displacement of the second hydraulic power means when $T_{x_{max}}$ is less than $T_h$ according to the judgment of the first discrimination module, such that a recovery torque of the second hydraulic power means $T_x=T_{x_{max}}$, and balancing $T_h$ by $T_x$ in cooperation with a braking torque of the engine; and adjusting the displacement of the second hydraulic power means to make a recovery torque of the second hydraulic power means $T_x=T_h$ when $T_{x_{max}}$ is not less than $T_h$.

In one embodiment of the present invention, wherein the accumulator also releases the stored hydraulic energy when the crane needs energy to drive the hydraulic actuator to perform an operation;

the second hydraulic power means also converts the hydraulic energy released by the accumulator into mechanical energy of the transmission shaft;

the system further comprises a main pump for converting the mechanical energy of the transmission shaft into hydraulic energy in order to drive the hydraulic actuator to perform a corresponding operation.

In one embodiment of the present invention, the main pump converts mechanical energy of the transmission shaft into hydraulic energy and providing the hydraulic energy to the derricking cylinder;

the hydraulic actuator includes a derricking cylinder for implementing derricking lifting of the crane arm by using the hydraulic energy provided by the main pump.

In one embodiment of the present invention, the main pump converts the mechanical energy of the transmission shaft into hydraulic energy and providing the hydraulic energy to the winch motor;

the hydraulic actuator includes a winch motor for implementing winching lifting of the load by using the hydraulic energy provided by the main pump.

In one embodiment of the present invention, a third torque acquisition module for acquiring, in real time, a load torque $T_d$ output by the main pump in the process that the second hydraulic power means converts the hydraulic energy released by the accumulator into the mechanical energy of the transmission shaft;

a fourth torque acquisition module for acquiring a maximum driving torque $T_{xc_{max}}$ that can be provided by the second hydraulic power means in the process that the second hydraulic power means converts the hydraulic energy released by the accumulator into the mechanical energy of the transmission shaft; and, a second discrimination module for judging whether or not $T_{xc_{max}}$ is less than $T_d$;

wherein the second displacement adjustment module also maximizes the displacement of the second hydraulic power means when $T_{xc_{max}}$ is less than $T_d$ according to the judgment of the second discrimination module, such that the driving torque provided by the second hydraulic power means $T_{xc}=T_{xc_{max}}$, and driving the main pump by $T_{xc}$ in cooperation with a driving torque of the engine; and adjusting the displacement of the second hydraulic power means when $T_{xc_{max}}$ is no less than $T_d$ such that the driving torque provided by the second hydraulic power means $T_{xc}=T_d$.

According to another aspect of the present invention, a crane including a system for recovering and utilizing crane operating energy according to any of aforementioned embodiments is provided.

The present invention can effectively recover gravitational potential energy generated in a lowering process of a load during crane lifting and derricking operations, and can reuse the recovered energy for driving in winch and derricking manners. This reduces fuel consumption, saves energy and reduces emission in crane operations. Moreover, in a lowering process of the load, a variable pump is adopted to adjust the lowering speed of the load, in replace of the current way of speed adjustment by a balance valve. In other words, volume speed governing replaces throttle speed governing, which reduces the amount of heat generated by the system, lengthens the service life of hydraulic components and reduces the power of the crane cooling system.

BRIEF DESCRIPTION OF THE DRAWINGS

In order to describe the technical solutions in the embodiments of the present invention or the prior art more clearly, the following part will make a brief introduction of the figures to be used for describing the embodiments or the prior art. Apparently, the figures to be described in the following part merely illustrate some embodiments of the present invention, and a person skilled in the art may also derive other figures according to said figures without paying any creative effort.

DETAILED DESCRIPTION OF THE EMBODIMENTS

The following part will make a clear and comprehensive description of the technical solutions in the embodiments of the present invention with reference to the figures in the embodiments of the present invention. Apparently, what described is only a part, rather than all, of the embodiments of the present invention. The following description of at least one exemplary embodiment is only illustrative, rather than making a limitation of the present invention or its application or usage. On a basis of the embodiments of the present invention, all the other embodiments obtained by a person skilled in the art without paying any creative effort belong to the scope of protection of the present invention.

Unless otherwise specifically noted, the relative disposition, numerical expressions and values in the components and steps described in these embodiments do not limit the scope of the present invention.

Meanwhile, it should be appreciated that for the convenience of description, the size of each component shown in the figures is not drawn according to an actual proportional relationship.

Technologies, methods and devices which are known to an ordinary person skilled in the art may not be discussed in detail, but in suitable cases, these technologies, methods and devices should be deemed as a part of the description for which a patent right is to be granted.

In all the examples shown and discussed here, any specific value shall be interpreted as merely illustrative, instead of making a limitation. Therefore, other examples of the exemplary embodiments may have different values.

It should be noted that similar reference signs and letters denote similar items in the following figures. Therefore, once a certain item is defined in one figure, it will not be discussed in the following figures.

Figure 1:
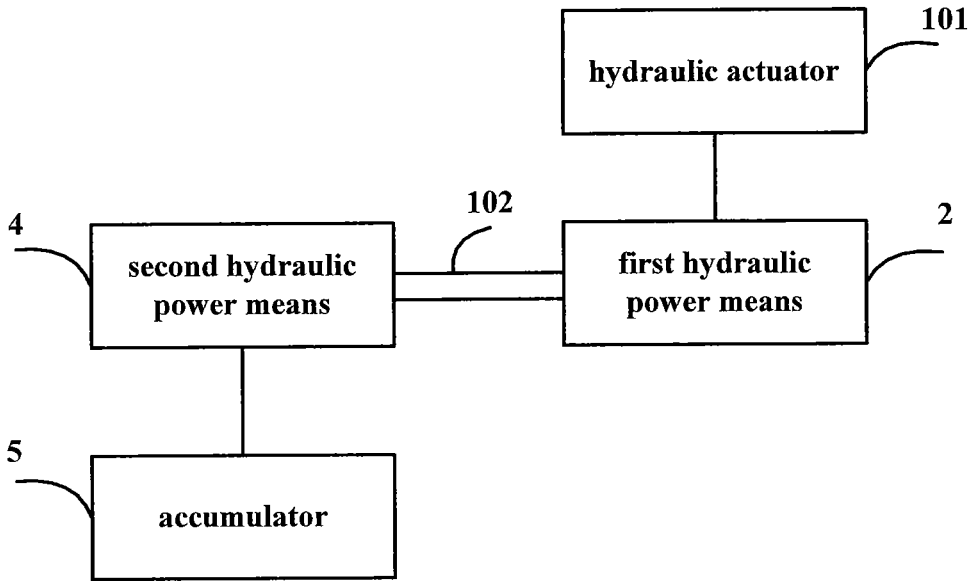
FIG. 1 is a schematic diagram of one embodiment of a system for recovering and utilizing crane operating energy in the present invention.

FIG. 1 is a schematic diagram of one embodiment of a system for recovering and utilizing crane operating energy in the present invention. As illustrated by FIG. 1, the system for recovering and utilizing crane operating energy includes a hydraulic actuator 101, a first hydraulic power means 2, a transmission shaft 102, a second hydraulic power means 4 and an accumulator 5.

The first hydraulic power means 2 and the second hydraulic power means 4 are connected via the transmission shaft 102.

The hydraulic actuator 101 is used for generating hydraulic energy,

Preferably, the hydraulic actuator 101 includes a hydraulic motor and/or a hydraulic cylinder, wherein the hydraulic motor generates hydraulic energy when a load is lowered, and the hydraulic cylinder generates hydraulic energy in a lowering process.

The first hydraulic power means 2 is used for converting the hydraulic energy generated by the hydraulic actuator into mechanical energy of the transmission shaft.

The transmission shaft 102 is used for driving the second hydraulic power means to rotate so as to convert the mechanical energy of the transmission shaft into mechanical energy of the second hydraulic power means.

The second hydraulic power means 4 is used for filling pressurized oil into the accumulator so as to convert the mechanical energy of the second hydraulic power means into hydraulic energy for storage.

The accumulator 5 is used for storing the hydraulic energy.

On a basis of the system for recovering and utilizing crane operating energy provided in the above embodiment of the invention, energy released by the hydraulic actuator in the lowering process is recovered and utilized, which achieves the purpose of saving energy, reducing emission and reduces the amount of heat generated by the system.

In the following part, the system for recovering and utilizing crane operating energy of the present invention will be introduced in detail by three embodiments.

The First Embodiment

Figure 2:
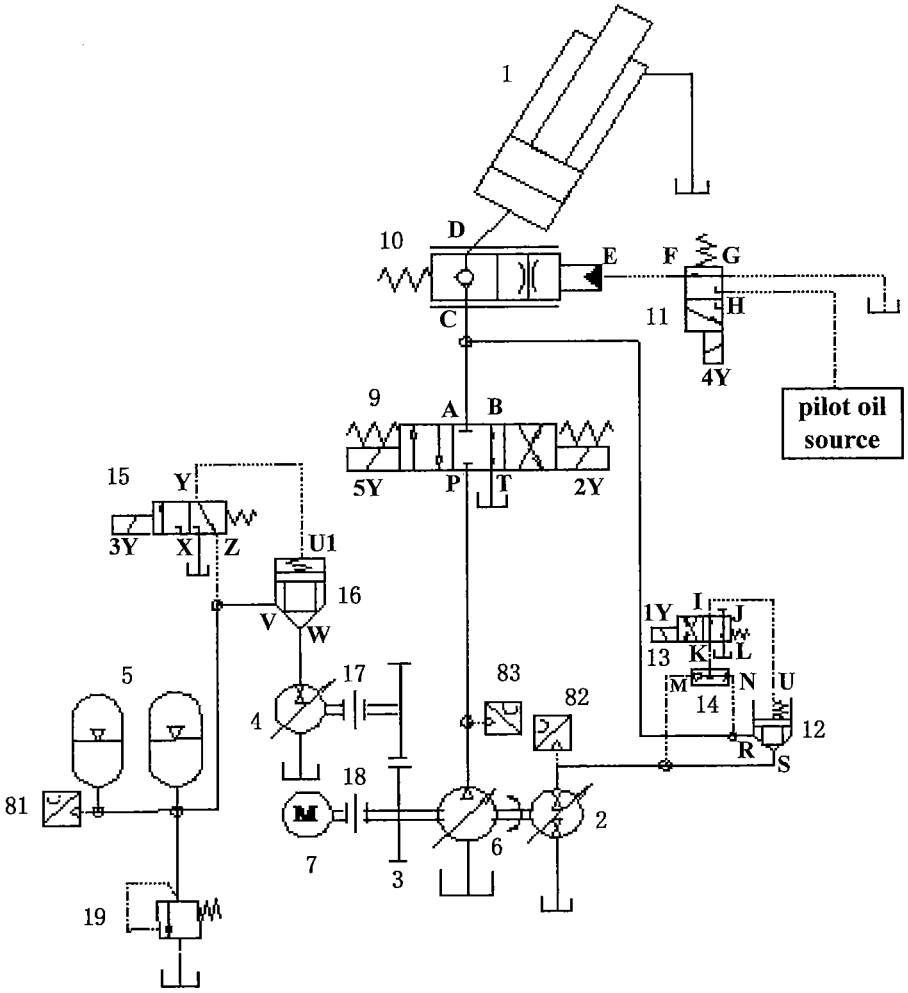
FIG. 2 is a schematic diagram of a first embodiment of a system for recovering and utilizing crane operating energy in the present invention.

FIG. 2 is a schematic diagram of a first embodiment of a system for recovering and utilizing crane operating energy in the present invention. In the embodiment of FIG. 2, the hydraulic actuator 101 in FIG. 1 is specifically a derricking cylinder.

As illustrated by FIG. 2, the system for recovering and utilizing crane operating energy includes a derricking cylinder 1, a first hydraulic power means 2, a transfer case 3, a second hydraulic power means 4, an accumulator 5, a derricking balance valve 10, a first main selector valve 9, a main pump 6 and an engine 7.

An oil outlet of the main pump 6 is communicated with a first working oil port P of the first main selector valve 9; a second working oil port A of the first main selector valve 9 is communicated with a first working oil port C of the derricking balance valve 10; and a second working oil port D of the derricking balance valve 10 is communicated with a rodless chamber of the derricking cylinder 1.

The first working oil port C of the derricking balance valve 10 is communicated with an oil inlet of the first hydraulic power means 2; the first hydraulic power means 2 is connected coaxially to the main pump 6 via a transmission shaft; the transfer case 3 is connected to an output shaft from the engine 7 to the main pump 6; the engine 7 is connected in parallel to the second hydraulic power means 4 via the transfer case 3; and the second hydraulic power means 4 is communicated with the accumulator 5.

The derricking cylinder 1 is used for converting gravitational potential energy generated during derricking lowering of a crane arm into hydraulic energy.

The first hydraulic power means 2 is used for converting hydraulic energy generated by the derricking cylinder into mechanical energy of the transmission shaft.

The transfer case 3 is used for driving the second hydraulic power means 4 to rotate by the mechanical energy of the transmission shaft.

The second hydraulic power means 4 is used for filling pressurized oil, such as hydraulic oil, into the accumulator so as to convert the mechanical energy of the second hydraulic power means into hydraulic energy for storage.

The accumulator 5 is used for storing the hydraulic energy.

The system for recovering and utilizing crane operating energy in the above embodiment of the present invention can effectively recover the energy generated in a lowering process of a sling load and the crane arm in a crane derricking operation, and then reuse the energy, which reduces fuel consumption, saves energy and reduces emission in the crane operation. In the present invention, in the derricking lowering process, the speed of derricking lowering is adjusted by filling pressurized oil into an accumulator, in replace of the current way of adjusting speed by a balance valve, which reduces the amount of heat generated by the system, lengthens the service life of hydraulic components and reduces the power of the crane cooling system.

In one embodiment of the present invention, the transfer case 3 may be a gear set.

In one embodiment of the present invention, the first hydraulic power means 2 includes a first variable pump and a first pump motor; and the second hydraulic power means 4 includes a second variable pump and a second pump motor.

In one embodiment of the present invention, as illustrated by FIG. 2, the system further includes a pilot oil source, a first selector valve 11, a second selector valve 13, a first cartridge valve 12 and a shuttle valve 14.

An oil outlet of the pilot oil source is communicated with a first working oil port H of the first selector valve 11, and a second working oil port F of the first selector valve 11 is communicated with a control oil port of the derricking balance valve.

A first oil inlet K of the second selector valve 13 is communicated with an oil outlet of the shuttle valve 14, and a first oil inlet N and a second oil inlet M of the shuttle valve 14 are communicated with a first working oil port R and an oil outlet S of the first cartridge valve 12 respectively.

As illustrated by FIG. 2, in the derricking lowering process, electromagnets 1Y and 4Y are energized; the derricking cylinder 1 and the first hydraulic power means 2 form a pump control cylinder loop; the first main selector valve 9 is in a middle position; and the first working oil port P and the second working oil port A of the main selector valve are not communicated with each other.

The electromagnet 4Y is energized; the first selector valve 11 is in a lower position; and a first working oil port H and a second working oil port F of the first selector valve 11 are communicated with each other, such that oil from the pilot oil source flows into a pilot oil port E of the derricking balance valve 10, and consequently the derricking balance valve 10 is reversely conducted, and pressurized oil of the rodless chamber of the derrick cylinder 1 flows to the first working oil port R of the first cartridge valve through the derricking balance valve 10.

The electromagnet 1Y is energized, such that the second selector valve 13 is in a left position; there is no pressurized oil in a control oil port U of the cartridge valve 12, and accordingly the first cartridge valve 12 will be opened, and a first working oil port R of the first cartridge valve 12 is communicated with a first working oil port C of the derricking balance valve 10. Accordingly, the first hydraulic power means 2 and the derricking cylinder 1 form a passage to recover the gravitational potential energy generated by the sling load and the crane arm during derricking lowering of the crane arm.

The hydraulic energy generated by the derricking cylinder 1 drives the first hydraulic power means 2 to rotate, so that the first hydraulic power means 2 converts hydraulic energy generated by the derricking cylinder 1 into mechanical energy of the transmission shaft.

The mechanical energy of the transmission shaft drives the main pump 6, the transfer case 3 and the second hydraulic power means 4 to rotate so as to convert the mechanical energy of the transmission shaft into rotational kinetic energy of the second hydraulic power means 4.

The second hydraulic power means 4 will rotate so as to fill hydraulic oil into the accumulator 5, so as to complete conversion from mechanical energy to hydraulic energy, and at last to achieve recovery of the derricking energy.

The accumulator 5 is used for storing hydraulic energy.

In the above embodiment of the present invention, when the derricking system performs energy recovering, it mainly adopts a balance valve for locking the derricking cylinder.

In one embodiment of the present invention, a switching valve may be adopted in replace of a derricking balance valve to lock the cylinder, which may also achieve the effect of recovering and reusing the derricking energy.

In one embodiment of the present invention, a switching valve may be adopted in replace of the first cartridge valve to lock the first hydraulic power means, which may also achieve the effect of recovering and reusing the derricking energy.

In one embodiment of the present invention, during derricking lowering, the first working oil port R of the first cartridge valve 12 may be communicated with the second working oil port D of the derricking balance valve 10, i.e., the first working oil port R of the first cartridge valve can be connected to an oil path between the balance valve and the rodless chamber of the derricking valve. By doing this, the effect of recovering and reusing the derricking energy can also be achieved.

In one embodiment of the present invention, the system also includes a first displacement adjustment module.

The first displacement adjustment module is used for adjusting the displacement of the first hydraulic power means 2 in the entire derricking lowering process of the crane arm so as to control the speed of derricking lowering of the crane arm thereby to avoid a fast derricking lowering.

In the above embodiment of the present invention, in a process of lowering a load, a variable pump is adopted to adjust the speed of lowering the load, in replace of the current way of speed governing by a balance valve; namely, volume speed governing replaces throttle speed governing, which reduces the amount of heat generated by the system, lengthens the service life of hydraulic components and reduces the power of the crane cooling system.

In one embodiment of the present invention, in the crane operation process, a crane controller outputs an electric current signal according to an angle of a crane maneuvering handle to control the displacement of the first hydraulic power means 2 thereby to control the speed of derricking lowering, so as to calculate a torque output by the first hydraulic power means 2 to the shaft of the transfer case, i.e., a recoverable energy torque $T_h$.

Figure 3:
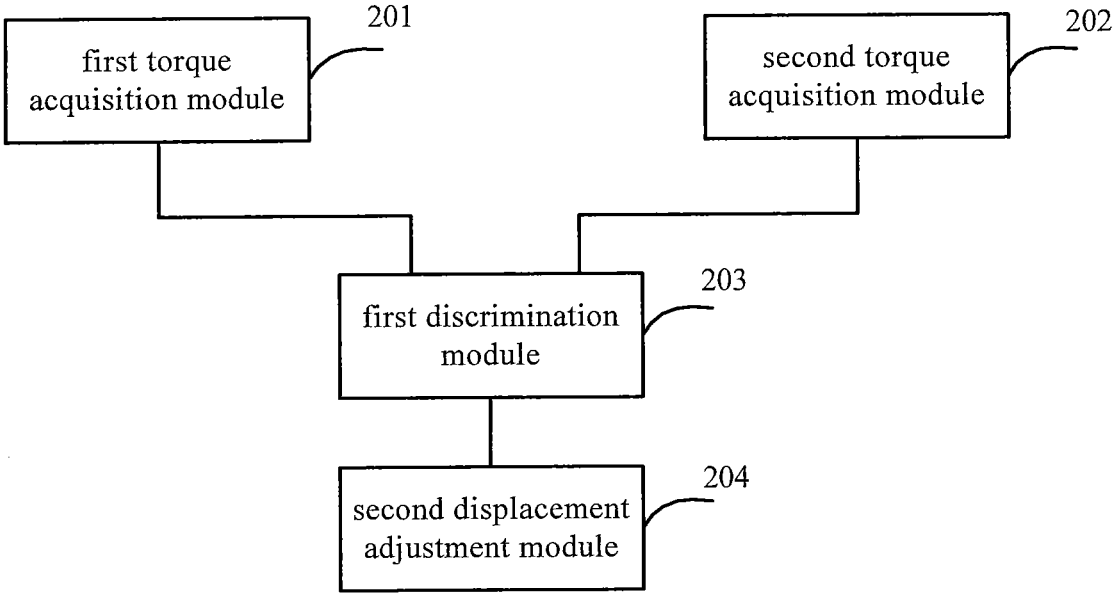
FIG. 3 is a schematic diagram of another embodiment of a system for recovering and utilizing crane operating energy in the present invention.

In one embodiment of the present invention, the system may also include a first torque acquisition module 201, a second torque acquisition module 202, a first discrimination module 203, a second displacement adjustment module 204 shown in FIG. 3 and a first switch 17 and a second switch 18 shown in FIG. 2.

The first torque acquisition module 201 is connected to the first hydraulic power means 2 in FIG. 2, and the second torque acquisition means 202 is connected to the second hydraulic power means 4.

As illustrated by FIG. 2, the first switch 17 is placed between the second hydraulic power means 4 and the transfer case 3, and the second switch 18 is placed between the engine 7 and the transfer case 3.

The first torque acquisition module 201 is used for acquiring, in real time, a load torque $T_h$ output by the first hydraulic power means 2 to the transfer case 3 in a derricking lowering process of the crane arm.

In one embodiment of the present invention, the first torque acquisition module 201 may acquire the load torque $T_h$ by obtaining the displacement of the first hydraulic power means 2 and a measurement value of a first pressure sensor 82.

The second torque acquisition module 202 is used for acquiring a maximum recovery torque $T_{x_{max}}$ of the second hydraulic power means 4.

In one embodiment of the present invention, the second torque acquisition module 202 may acquire the maximum recovery torque $T_{x_{max}}$ by obtaining a maximum displacement of the second hydraulic power means 4 and the pressure of the accumulator detected by the second pressure sensor 81.

The first discrimination module 203 is used for judging whether or not $T_{x_{max}}$ is less than $T_h$.

The second displacement adjustment module 204 is used for maximizing the displacement of the second hydraulic power means 4 when $T_{x_{max}}$ is less than $T_h$ according to the judgment of the first discrimination module 203, such that a recovery torque $T_x$ of the second hydraulic power means 4 is equal to $T_{x_{max}}$, i.e., $T_x=T_{x_{max}}$; and triggering the first switch 17 and the second switch 18 to be turned on thereby to balance $T_h$ by $T_x$ in cooperation with a braking torque of the engine 7. In other words, the second hydraulic power means 4 can only partially recover the mechanical energy of the first hydraulic power means 2 (i.e., partially recover the derricking energy of the derricking mechanism).

In one embodiment of the present invention, the second displacement adjustment module 204 is also used for adjusting the displacement of the second hydraulic power means 4 in such a way that a recovery torque $T_x$ of the second hydraulic power means 4 is equal to $T_h$ i.e., $T_x=T_h$, when $T_{x_{max}}$ is no less than $T_h$, according to the judgment of the first discrimination module 203; and triggering the first switch 17 to be turned on and the second switch 18 to be turned off so as to balance $T_h$ entirely by $T_x$. In other words, the second hydraulic power means 4 can recover all the mechanical energy of the first hydraulic power means 2 (i.e., recover all the derricking energy of the derricking mechanism).

The above embodiment of the present invention manages to adjust the displacement of the second hydraulic power means so as to adjust the recovery torque of the second hydraulic power means thereby to recover the derricking energy of the derricking mechanism as much as possible, and thus achieves the effect of saving energy, reducing emission and reducing the heat generated by the system better.

In one embodiment of the present invention, the first switch 17 and the second switch 18 can both be clutches.

In one embodiment of the present invention, according to FIG. 2, the system also includes a first pressure sensor 81.

The first pressure sensor 81 is connected to the accumulator 5 for detecting the pressure of the accumulator 5.

The first switch 17 is also used for cutting off the connection between the second hydraulic power means 4 and the transfer case 3 to balance $T_h$ entirely by a braking torque of the engine 7 when the pressure detected by the first pressure sensor 81 reaches a maximum working pressure.

In the above embodiment of the present invention, as the load is lowered and the process of energy recovery continues, the pressure of the accumulator is continuously increased, and when the pressure of the accumulator reaches a maximum working pressure which is preset for the accumulator, the connection between the second hydraulic power means 4 and the transfer case 3 is cut off, and $T_h$ is balanced entirely by the braking torque of the engine 7.

In one embodiment of the present invention, as illustrated by FIG. 2, the system also includes a third selector valve 15 and a second cartridge valve 16.

A first working oil port X of the third selector valve 15 is communicated with the oil return loop; the second working oil port Y is communicated with a control port U1 of the second cartridge valve 16; and the third working oil port Z is communicated with the accumulator 5.

The first working oil port V of the second cartridge valve 16 is communicated with the accumulator 5, and the second working oil port W is communicated with the second hydraulic power means 4.

In the derricking lowering process of the crane arm, electromagnet 3Y is energized; the third selector valve 15 is in a left position; there is no pressurized oil at the control oil port U1 of the second cartridge valve 16; the first working port V and the second working oil port W of the second cartridge valve 16 are communicated with each other; and the accumulator 5 is communicated with the second hydraulic power means 4, to achieve recovery of derricking energy.

When the pressure detected by the first pressure sensor 81 reaches the maximum working pressure, the electromagnet 3Y is de-energized; the third selector valve 15 is in a right position; there is pressurized oil at the control oil port U1 of the second cartridge valve 16; the first working oil port V and the second working oil port W of the second cartridge valve 16 are disconnected from each other; and the accumulator 5 is disconnected from the second hydraulic power means 4, such that $T_h$ is balanced entirely by a braking torque of the engine 7.

In one embodiment of the present invention, a switching valve may be adopted in replace of the cartridge valve 16 to lock the accumulator, which can also achieve the effect of recovering and reusing derricking energy.

In one embodiment of the present invention, as illustrated by FIG. 2, the system also includes a relief valve 19 communicated with the accumulator 5.

The relief valve 19 is configured to be opened when the pressure detected by the first pressure sensor 81 reaches a preset maximum working pressure (i.e., when the accumulator is full), such that the accumulator maintains a constant pressure, and energy recovery is ended.

In one embodiment of the present invention, the accumulator 5 is also configured to release stored hydraulic energy when the crane performs a lifting operation and the accumulator has remaining energy, in order to provide a driving force to the hydraulic actuator of the crane.

In one embodiment of the present invention, the hydraulic actuator may include at least one of such hydraulic actuators as a derricking cylinder, a winch motor and a rotary motor, etc.

In one embodiment of the present invention, when the crane arm is lifted in a derricking manner, electromagnets 3Y and 5Y are energized, and the main pump and the derricking cylinder form an open pump control cylinder loop to drive the derricking system.

Specifically, the electromagnet 3Y is energized; the third selector valve 15 is in a left position; there is no pressurized oil at the control oil port U1 of the second cartridge valve 16; the first working oil port V and the second working oil port W of the second cartridge valve 16 are communicated with each other; the accumulator 5 is communicated with the second hydraulic power means 4, such that high-pressurized oil in the accumulator 5 passes through the second cartridge valve 16 to drive the second hydraulic power means 4 to rotate.

The second hydraulic power means 4 drives the transfer case to rotate through the switch 1, so as to transfer mechanical energy to the transmission shaft, and provide a driving force to the transmission shaft in cooperation with the engine, so as to achieve reuse of the stored hydraulic energy.

The electromagnet 5Y is energized; the first main selector valve 9 is in a left position; and a first working oil port P and a second working oil port A of the main selector valve are communicated with each other. The main pump 6 is also used for converting mechanical energy of the transmission shaft into hydraulic energy to drive the derricking cylinder 1 to lift the crane arm in a derricking manner. At this time, for lifting of the derricking cylinder, hydraulic oil can be provided by the main pump or a variable pump/motor.

In one embodiment of the present invention, the system also includes a third displacement adjustment module.

The third displacement module is used for adjusting the displacement of the main pump 6 to control the speed of derricking lifting during a derricking lifting process.

In one embodiment of the present invention, in the crane operation process, the crane controller outputs an electrical current signal according to an angle of the crane maneuvering handle to control the displacement of the main pump thereby to control the speed of derricking lifting so as to obtain an output torque $T_d$ of the main pump.

Figure 4:
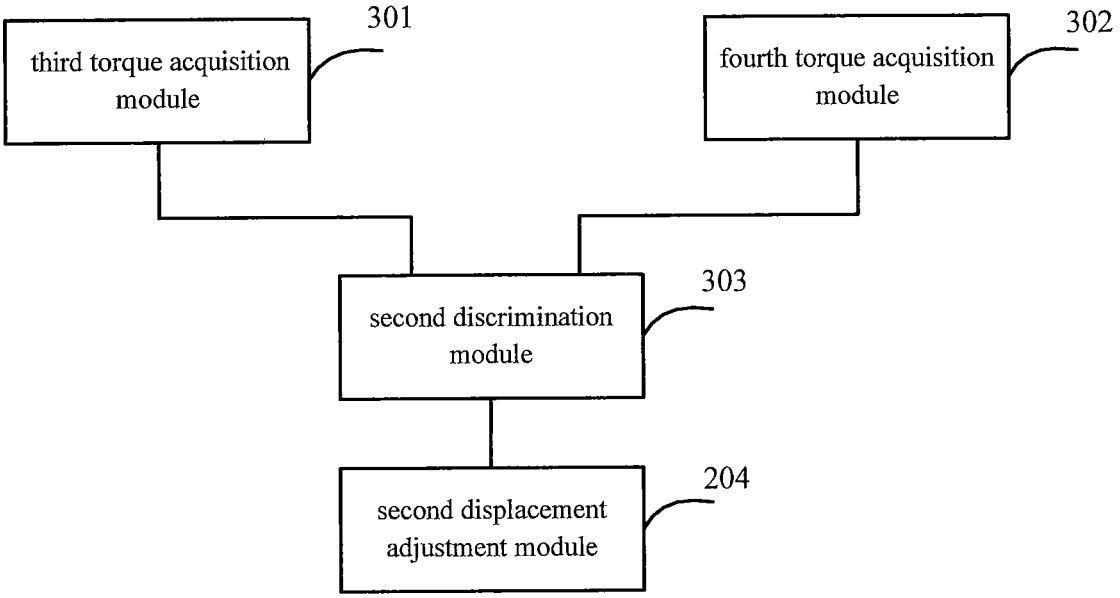
FIG. 4 is a schematic diagram of yet another embodiment of a system for recovering and utilizing crane operating energy in the present invention.

In one embodiment of the present invention, the system also includes a third torque acquisition module 301, a fourth torque acquisition module 302 and a second discrimination module 303 shown in FIG. 4.

The third torque acquisition module 301 is communicated with the main pump, and the fourth torque acquisition module 302 is communicated with the second hydraulic power means; and the second discrimination module 303 is communicated with the third torque acquisition module and the fourth torque acquisition module, respectively.

The third torque acquisition module 301 is used for acquiring, in real time, a load torque $T_d$ output by the main pump 6 during the derricking lifting of the crane arm.

In one embodiment of the present invention, the third torque acquisition module 301 may acquire a load torque $T_d$ output by the main pump 6 according to the obtained displacement of the main pump 6 and a measurement amount of the third pressure sensor 83.

The fourth torque acquisition module 302 is used for acquiring a maximum driving torque $T_{xc_{max}}$ that can be provided by the second hydraulic power means 4.

In one embodiment of the present invention, the second torque acquisition module 202 may acquire the maximum driving torque $T_{xc_{max}}$ according to an obtained maximum displacement of the second hydraulic power means 4 and the pressure of the accumulator detected by the second pressure sensor 81.

The second discrimination module 303 is used for judging whether or not $T_{xc_{max}}$ is less than $T_d$.

The second displacement adjustment module 204 is also used for maximizing the displacement of the second hydraulic power means 4 such that the driving torque $T_{xc}$ of the second hydraulic power means 4 is equal to $T_{xc_{max}}$, i.e., $T_{xc}=T_{xc_{max}}$, when $T_{xc_{max}}$ is less than $T_d$, according to the judgment of the second discrimination module 303; and triggering the first switch 17 and the second switch 18 to be turned on, such that the main pump 6 is driven by the driving torque $T_{xc}$ of the second hydraulic power means 4 in cooperation with the driving torque of the engine 7.

The above embodiment of the present invention manages to adjust the displacement of the second hydraulic power means thereby to adjust the driving torque of the second hydraulic power means so as to use the stored energy of the accumulator as much as possible, which realizes the purposes of saving energy, reducing emission and reducing the heat generated by the system.

In one embodiment of the present invention, the second displacement adjustment module 204 is also used for adjusting the displacement of the second hydraulic power means 4 in such a way that a driving torque $T_{xc}$ of the second hydraulic power means 4 is equal to $T_d$, i.e., $T_{xc}=T_d$, when $T_{xc_{max}}$ is no less than $T_d$, according to the judgment of the second discrimination module 303; and triggering the first switch 17 to be turned on and the second switch 18 to be turned off. In other words, the main pump is driven entirely depending on the second hydraulic power means.

In one embodiment of the present invention, the first switch 17 is also used for cutting off the connection between the second hydraulic power means 4 and the transfer case 3 and turning on the second switch 18 when the pressure detected by the first pressure sensor 81 reaches a predetermined minimum working pressure, such that the main pump 6 is driven entirely depending on the engine 7.

In embodiment of the present invention, as the lifted load rises, high-pressurized oil in the accumulator is output, and pressure within the accumulator is continuously decreased; when the pressure of the accumulator is higher than a certain preset value of inflation pressure of the accumulator, the displacement control signal of the second hydraulic power means is set to be zero, and the electromagnet 3Y is de-energized, and the second cartridge valve 6 is disconnected, and the first switch 17 is disconnected, such that power is provided entirely depending on the engine.

In the embodiment in FIG. 2 of the present invention, the derricking cylinder 1 and the first hydraulic power means 2 form an open pump control cylinder loop so as to convert the gravitational potential energy generated by the sling load and the crane arm in the derricking lowering process of the crane arm into mechanical energy of the first hydraulic power means 2.

In one embodiment of the present invention, the derricking cylinder 1 and the first hydraulic power means 2 may also form a close pump control cylinder loop so as to convert the gravitational potential energy generated by the sling load and the crane arm in the derricking lowering process of and the crane arm into mechanical energy of the first hydraulic power means 2.

The system for recovering and utilizing crane operating energy in the second embodiment of the present invention is a system for recovering and utilizing derricking energy of the crane.

The Second Embodiment

Figure 5:
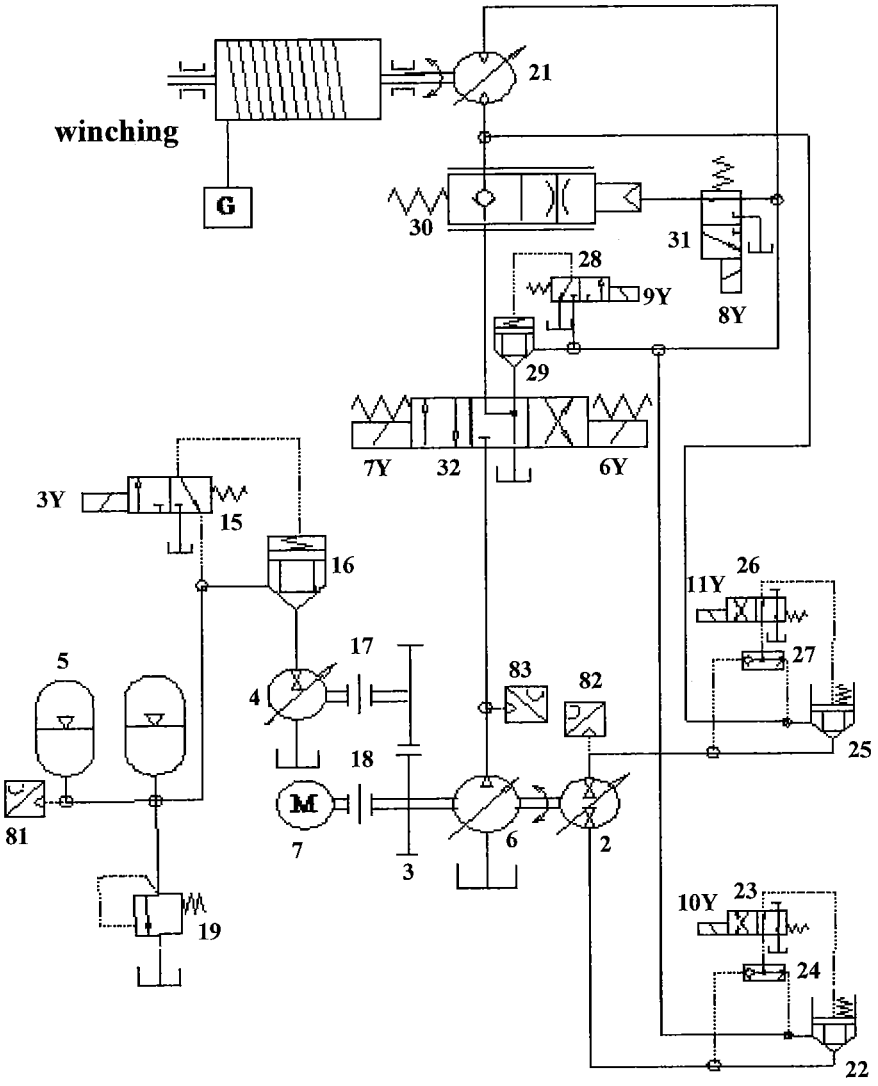
FIG. 5 is a schematic diagram of a second embodiment of a system for recovering and utilizing crane operating energy in the present invention.

FIG. 5 is a schematic diagram of a second embodiment of a system for recovering and utilizing crane operating energy in the present invention. In the embodiment of FIG. 5, the hydraulic actuator 101 in FIG. 1 is specifically a winch motor.

As illustrated by FIG. 5, the system for recovering and utilizing the crane operating energy includes a winch motor 21, a first hydraulic power means 2, a transfer case 3, a second hydraulic power means 4 and an accumulator 5, a balance valve 30, a second main selector valve 32, a main pump 6 and an engine 7.

An oil outlet of the main pump 6 is communicated with an oil inlet of the second main selector valve 32; a first working oil port of the second main selector valve 32 is communicated with a first working oil port of the balance valve 30; and a second working oil port of the balance valve 30 is communicated with a lifting hole of the winch motor 21.

A second working oil port of the balance valve 30 is communicated with an oil inlet of the first hydraulic power means 2; the first hydraulic power means 2 is connected coaxially to the main pump 6; the transfer case 3 is connected to an output shaft from the engine 7 to the main pump 6; the engine 7 is connected in parallel to the second hydraulic power means 4 via the transfer case 3; and the second hydraulic power means 4 is communicated with the accumulator 5.

The winch motor 21 and the first hydraulic power means 2 form a close pump control motor loop for converting gravitational potential energy generated during the lowering process of the sling load of the crane into hydraulic energy.

The first hydraulic power means 2 (one-level secondary component) is used for converting the hydraulic energy generated by the winch motor into mechanical energy of the transmission shaft.

The transfer case 3 is used for driving the second hydraulic power means to rotate by means of the mechanical energy of the transmission shaft.

The second hydraulic power means 4 (two-level secondary component) is used for filling pressurized oil, such as hydraulic oil, into the accumulator so as to convert the mechanical energy of the second hydraulic power means into hydraulic energy for storage.

The accumulator 5 is used for storing hydraulic energy.

Based on the system for recovering and utilizing crane operating energy provided in the above embodiment of the present invention, in the process that the load of the lifting system is lowered, the winch motor and the first hydraulic power means form a close pump control system, and the first hydraulic power means drives the second hydraulic power means to fill pressurized oil into the accumulator so as to recover the energy generated during the lowering process of the load; in this way, the energy generated during the process of lowering the load in the lifting operation of the crane is effectively recovered and then reused, which reduces consumption of fuel oil in the crane operation, thereby to save energy and reduce emission.

In one embodiment of the present invention, the first hydraulic power means 2 includes a first variable pump and a first pump motor; and the second hydraulic power means 4 includes a second variable pump and a second pump motor.

In one embodiment of the present invention, as illustrated by FIG. 5, the system also includes a selector valve 31, a selector valve 26, a cartridge valve 25, a shuttle valve 27, a selector valve 23, a cartridge valve 22, a shuttle valve 29 and a selector valve 28.

As illustrated by FIG. 5, in the lowering process of the sling load, the electromagnets 11Y, 10Y, 8Y and 9Y are energized, and the first hydraulic power means 2 and the winch motor 21 form a passage to recover the winching potential energy. The winching potential energy turns into hydraulic energy via a drum, a winching reducer and a winch motor, and the winch motor 21 and the first hydraulic power means 2 form a close pump control motor loop to convert the potential energy of the load into mechanical energy. The torque generated by the load drives the first hydraulic power means to rotate, and the mechanical energy drives the second hydraulic power means 4 (two-level secondary component of variable pump/motor) to fill pressurized oil into the accumulator, and converts the mechanical energy into hydraulic energy for storage.

The specific process is described as follows.

The electromagnet 11Y is energized, and then the selector valve 26 is in a left position, and the control oil port of the cartridge 25 is communicated with the cylinder, i.e., there is no pressurized oil at the control oil port, so that the cartridge valve 25 will be opened accordingly.

The electromagnet 10Y is energized, and then the selector valve 23 is in a left position, and the control oil port of the cartridge valve 22 is communicated with the cylinder, i.e., there is no pressurized oil at the control oil port, so that the cartridge valve 22 will be opened accordingly.

The electromagnet 8Y is energized, and then the selector valve 31 is in a lower position, such that a pilot oil port of the balance valve 30 is communicated with the cylinder, i.e., there is no pressurized oil at the pilot oil port, so that the balance valve 30 is maintained in a closed state to guarantee that the potential energy of the load will not be subjected to throttling loss from the balance valve but will be recovered by the first hydraulic power means 2.

The electromagnet 9Y is energized, and then the selector valve 28 is in a right position, and the control oil port of the cartridge valve 29 is communicated with the return oil path of the first hydraulic power means 2, i.e., there is pressurized oil at the control oil port, and the cartridge valve 29 is disconnected to ensure that the return oil of the first hydraulic power means 2 can be replenished to a low-pressure chamber (a falling hole) of the winch motor in time.

At this time, electromagnets 7Y and 6Y are not energized, and the main selector valve is in a middle position state; the main pump is in a low-pressure relief state; and the main oil path does not participate in energy recovery.

Accordingly, when electromagnets 11Y, 10Y, 8Y and 9Y are energized, the first hydraulic power means 2 and the winch motor 21 form a close pump control motor loop to convert the potential energy of the load into mechanical energy.

In the lowering process of the sling load, winching potential energy turns into hydraulic energy via a drum, a winching reducer and a winch motor, and the hydraulic energy generated by the winch motor 21 drives the first hydraulic power means 2 to rotate, and the first hydraulic power means 2 converts the hydraulic energy generated by the winch motor 21 into mechanical energy of the transmission shaft.

The mechanical energy of the transmission shaft drives the main pump 6, the transfer case 3 and the second hydraulic power means 4 to rotate so as to convert the mechanical energy of the transmission shaft into rotational kinetic energy of the second hydraulic power means 4.

The second hydraulic power means 4 rotates to fill hydraulic oil into the accumulator 5, and finishes conversion from mechanical energy into hydraulic energy, and finally achieves recovery of the winching energy.

In the above embodiment, the process of energy recovery of a winch motor mainly utilizes a balance valve to perform locking of the winch motor.

In one embodiment of the present invention, when energy recovery is not performed, the first hydraulic power means 2 may be used for driving the rotary motor.

In one embodiment of the present invention, in the winching lowering process, as for the hydraulic oil in the falling port of the winch motor, in addition to replenishing oil by using a second variable pump of the first hydraulic power means, oil supply can also be performed by an additionally provided slippage pump.

In one embodiment of the present invention, a switching valve can be adopted in replace of the balance valve for locking the winch motor, which can also achieve the effect of recover and reusing the winching energy.

In one embodiment of the present invention, a switching valve can be adopted in replace of the cartridge valve 22 and the cartridge valve 25 to lock the first hydraulic power means, which can also achieve the effect of recovering and reusing the winching energy.

In one embodiment of the present invention, a switching valve can be used in replace of the cartridge valve 29 to lock the main selector valve, which can also achieve the effect of recovering and reusing the winching energy.

In one embodiment of the present invention, the system also includes a first displacement adjustment module.

The first displacement adjustment module is used for adjusting the displacement of the first hydraulic power means 2 in the lowering process of the load so as to control the lowering speed of the load thereby to avoid a fast lowering of the load.

In the above embodiment, in the lowering process of the load, a variable pump is adopted to adjust the lowering speed of the load, in replace of the current way of speed adjustment by a balance valve, which reduces the amount of heat generated by the system, lengthens the service life of the hydraulic components, and reduces the power of the crane cooling system.

In one embodiment of the present invention, in the crane operation process, a crane controller outputs an electric current signal according to an angle of a crane maneuvering handle to control the displacement of the first hydraulic power means 2 thereby to control the lowering speed of the load, so as to obtain, by calculation, a torque output by the first hydraulic power means 2 to the shaft of the transfer case, i.e., a recoverable energy torque $T_h$.

The system of the embodiment illustrated by FIG. 5 may also include a first switch 17, a second switch 18 and the first torque acquisition module 201, the second torque acquisition module 202, the first discrimination module 203 and the second discrimination module 204 shown in FIG. 3.

The first torque acquisition module 201 is connected to the first hydraulic power means 2 in FIG. 5, and the second torque acquisition module 202 is connected to the second hydraulic power means 4.

As illustrated by FIG. 5, the first switch 17 is provided between the second hydraulic power means 4 and the transfer case 3, and the second switch 18 is provided between the engine 7 and the transfer case 3.

The first torque acquisition module 201 is used for acquiring, in real time, a load torque $T_h$ output by the first hydraulic power means 2 to the transfer case 3 in the lowering process of the sling load.

In one embodiment of the present invention, the first torque acquisition module 201 may acquire the load torque $T_h$ by acquiring the displacement of the first hydraulic power means 2 and a measurement value of the first pressure sensor 82.

The second torque acquisition module 202 is used for acquiring a maximum recovery torque $T_{x_{max}}$ of the second hydraulic power means 4.

In one embodiment of the present invention, the second torque acquisition module 202 may acquire the maximum recovery torque $T_{x_{max}}$ by acquiring the maximum displacement of the second hydraulic power means 4 and the pressure of the accumulator detected by the second pressure sensor 81.

The first discrimination module 203 is used for judging whether or not $T_{x_{max}}$ is less than $T_h$.

The second displacement adjustment module 204 is used for maximizing the displacement of the second hydraulic power means 4 when $T_{x_{max}}$ is less than $T_h$ according to the judgment of the first discrimination module 203, such that a recovery torque $T_x$ of the second hydraulic power means 4 is equal to $T_{x_{max}}$, i.e., $T_x=T_{x_{max}}$; and triggering the first switch 17 and the second switch 18 to be turned on thereby to balance $T_h$ by $T_x$ in cooperation with a braking torque of the engine 7. In other words, the second hydraulic power means 4 can only partially recover the mechanical energy of the first hydraulic power means 2 (i.e., partially recover the winching energy of the winch mechanism).

In one embodiment of the present invention, the second displacement adjustment module 204 is also used for adjusting the displacement of the second hydraulic power means 4 in such a way that a recovery torque $T_x$ of the second hydraulic power means 4 is equal to $T_h$, i.e., $T_x=T_h$, when $T_{x_{max}}$ is no less than $T_h$, according to the judgment of the first discrimination module 203; and triggering the first switch 17 to be turned on and the second switch 18 to be turned off to balance $T_h$ entirely by $T_x$. In other words, the second hydraulic power means 4 can recover all the mechanical energy of the first hydraulic power means 2 (i.e., recover all the winching energy of the winch mechanism).

The above embodiment of the present invention manages to adjust the displacement of the second hydraulic power means so as to adjust the recovery torque of the second hydraulic power means thereby to recover the winching energy of the winch mechanism as much as possible, and thus achieves the effect of saving energy, reducing pollution and reducing the amount of heat generated by the system better.

In one embodiment of the present invention, the first switch 17 and the second switch 18 can both be clutches.

In one embodiment of the present invention, according to FIG. 1, the system also includes a first pressure sensor 81.

The first pressure sensor 81 is connected to an accumulator 5 for detecting the pressure of the accumulator 5.

The first switch 17 is also used for cutting off the connection between the second hydraulic power means 4 and the transfer case 3 and balancing $T_h$ entirely by a braking torque of the engine 7 when the pressure detected by the first pressure sensor 81 reaches a determined maximum working pressure.

In the above embodiment of the present invention, as the sling load is lowered and the process of energy recovery continues, the pressure of the accumulator is continuously increased, and when the pressure of the accumulator reaches a maximum working pressure which is preset for the accumulator, the connection between the second hydraulic power means 4 and the transfer case 3 is cut off, and $T_h$ is balanced entirely by the braking torque of the engine 7.

In one embodiment of the present invention, as illustrated by FIG. 5, the system also includes a selector valve 15 and a cartridge valve 16.

In the lowering process of the load, electromagnet 3Y is energized; a fifth selector valve 15 is in a left position; there is no pressurized oil at the control oil port of the cartridge valve 16; a fourth cartridge valve 16 is closed; and the accumulator 5 is communicated with the second hydraulic power means 4, to achieve recovery of winching energy.

When the pressure detected by the first pressure sensor 81 reaches the determined maximum working pressure, the electromagnet 3Y is de-energized, and the selector valve 15 is in a right position; there is pressurized oil at the control oil port U1 of the cartridge valve 16; the cartridge valve 29 is disconnected; and the accumulator 5 is disconnected from the second hydraulic power means 4 so that $T_h$ is balanced entirely by a braking torque of the engine 7.

In one embodiment of the present invention, a switching valve may be adopted in replace of the cartridge valve 16 to lock the accumulator, which can also achieve the effect of recovering and reusing the winching energy.

In one embodiment of the present invention, as illustrated by FIG. 5, the system also includes a relief valve 19 in communication with the accumulator 5.

The relief valve 19 is configured to be opened when the pressure detected by the first pressure sensor 81 reaches the determined maximum working pressure (i.e., when the accumulator is full), such that the accumulator maintains a constant pressure, and energy recovery is ended.

In one embodiment of the present invention, the accumulator 5 is also used for releasing stored hydraulic energy when the crane performs a lifting operation and usable energy is detected, in order to provide a driving force to the hydraulic actuator of the crane.

In one embodiment of the present invention, the hydraulic actuator may include at least one of such hydraulic actuators as a derricking cylinder, a winch motor and a rotary motor, etc.

In one embodiment of the present invention, as illustrated by FIG. 5, the first hydraulic power means is also used for being disconnected from the winch motor (by disconnecting the cartridge valve 12) for not performing energy recovery when the sling load of the crane is lowered; the main pump is also used for being connected with the falling port of the winch motor (by placing the selector valve in the right position, making the cartridge valve 29 conducting, making the balance valve reverse conducting) and form an open loop with the winch motor when the first hydraulic power means is disconnected from the winch motor, so that the system performs open-type lowering.

In one embodiment of the present invention, as illustrated by FIG. 5, when sling load of the crane arm is lifted, electromagnet 7Y is energized, and the main pump and the winch motor form an open pump control motor loop to drive the winch system.

The specific process is described as follows.

The electromagnet 7Y is energized; the second main selector valve 32 is in a left position; the balance valve is forward conducted; and the oil outlet of the main pump is communicated with the lifting hole of the winch motor. The main pump 6 is used for converting mechanical energy of the transmission shaft into hydraulic energy to drive the winch motor 21 to lift the sling load. At this time, for performing lifting by the winch motor, hydraulic oil may be provided by the main pump.

When usable energy is detected in the accumulator, the second hydraulic power means 4 drives the transfer case to rotate via the switch 17, so as to transfer mechanical energy to the transmission shaft, and provide a driving force to the transmission shaft in cooperation with the engine, so as to achieve reuse of the stored hydraulic energy.

In the above embodiment of the present invention, in the process that the load of the lifting system is lowered, the winch motor and the first hydraulic power means form a close pump control motor system, and the first hydraulic power means drives the second hydraulic power means to fill pressurized oil into the accumulator so as to recover the energy when the load is lowered. In this way, the recovered energy can be released again for driving the transmission shaft to rotate so as to provide a driving force in cooperation with the engine.

The system for recovering and utilizing crane operating energy in the present invention not only can be used for a crane of an open pump control system, but also can be used for a crane of a load-sensitive pump valve control system and a close pump control system.

In one embodiment of the present invention, the system also includes a third displacement adjustment module.

The third displacement adjustment module is used for adjusting the displacement of the main pump 6 to control the speed of lifting the sling load in a process of lifting the sling load.

In one embodiment of the present invention, in the crane operation process, the crane controller outputs an electrical current signal according to an angle of the crane maneuvering handle to control the displacement of the main pump thereby to control the lifting speed of the sling load so as to obtain an output torque $T_d$ of the main pump.

In the embodiment shown in FIG. 5 of the present invention, the system also includes a third torque acquisition module 301, a fourth torque acquisition module 302 and a second discrimination module 303 shown in FIG. 4.

The third torque acquisition module 301 is communicated with the main pump, and the fourth torque acquisition module 302 is communicated with the second hydraulic power means; the second discrimination module 303 is communicated with the third torque acquisition module and the fourth torque acquisition module, respectively.

The third torque acquisition module 301 is used for acquiring, in real time, a load torque $T_d$ output by the main pump 6 when the sling load is lifted.

In one embodiment of the present invention, the third torque acquisition module 301 may acquire a load torque $T_d$ output by the main pump 6 according to the displacement of the main pump 6 and a measurement amount of the third pressure sensor 83.

The fourth torque acquisition module 302 is used for acquiring a maximum driving torque $T_{xc_{max}}$ that can be provided by the second hydraulic power means 4.

In one embodiment of the present invention, the second torque acquisition module 202 may acquire the maximum driving torque $T_{xc_{max}}$ by acquiring a maximum displacement of the second hydraulic power means 4 and the pressure of the accumulator detected by the second pressure sensor 81.

The second discrimination module 303 is used for judging whether or not $T_{xc_{max}}$ is less than $T_d$.

The second displacement adjustment module 204 is also used for maximizing the displacement of the second hydraulic power means 4 such that the driving torque $T_{xc}$ of the second hydraulic power means 4 is equal to $T_{xc_{max}}$, i.e., $T_{xc}=T_{xc_{max}}$, when $T_{xc_{max}}$ is less than $T_d$, according to the judgment of the second discrimination module 303; and triggering the first switch 17 and the second switch 18 to be turned on, such that the main pump 6 is driven by the driving torque $T_{xc}$ of the second hydraulic power means 4 in cooperation with the driving torque of the engine 7.

In one embodiment of the present invention, the second displacement adjustment module 204 is also used for adjusting the displacement of the second hydraulic power means 4 in such a way that a driving torque of the second hydraulic power means 4 is equal to $T_d$, i.e., $T_{xc}=T_d$, when $T_{xc_{max}}$ is no less than $T_d$, according to the judgment of the second discrimination module 303; and triggering the first switch to be turned on and the second switch to be turned off. In other words, the main pump is driven entirely depending on the second hydraulic power means.

The above embodiment of the present invention manages to adjust the displacement of the second hydraulic power means thereby to adjust the driving torque of the second hydraulic power means so as to use the energy stored by the accumulator as much as possible, which better realizes the purposes of saving energy, reducing emission and reducing the heat generated by the system.

In one embodiment of the present invention, the first switch 17 is also used for cutting off the connection between the second hydraulic power means 4 and the transfer case 3 and turning on the second switch 18 when the pressure detected by the first pressure sensor 81 reaches a predetermined minimum working pressure, such that the main pump 6 is driven entirely depending on the engine 7.

In embodiment of the present invention, as the lifted load rises, high-pressurized oil in the accumulator is output, and pressure within the accumulator is continuously decreased. When the pressure of the accumulator is reduced to be a preset minimum allowable pressure value, the displacement control signal of the second hydraulic power means is set to be zero. The electromagnet 3Y is de-energized. The fourth cartridge valve 16 is disconnected. The first switch 17 is turned off. Power is provided entirely depending on the engine.

In the embodiment in FIG. 5 of the present invention, the first hydraulic power means 2 and the winch motor 21 form a close pump control motor loop so as to convert potential energy of the load in the winching failing process into mechanical energy.

In one embodiment of the present invention, the first hydraulic power means 2 and the winch motor 21 may also form an open pump control motor loop to convert the potential energy of the load into mechanical energy, which may also achieve recovery of the winching energy.

The system for recovering and utilizing crane operating energy in the third embodiment of the present invention is a system for recovering and utilizing winching (motor) energy of the crane.

The Third Embodiment

Figure 6:
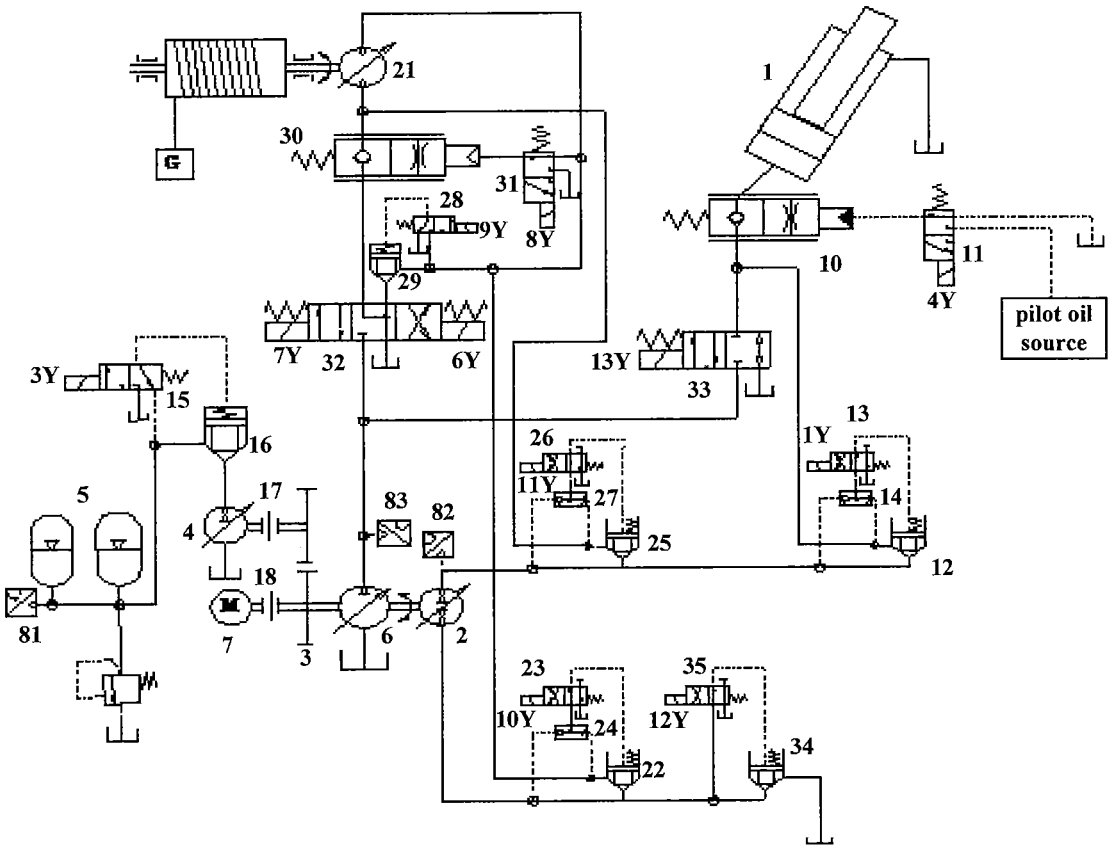
FIG. 6 is a schematic diagram of a third embodiment of a system for recovering and utilizing crane operating energy in the present invention.

FIG. 6 is a schematic diagram of a third embodiment of a system for recovering and utilizing crane operation system in the present invention. In the embodiment in FIG. 6, the hydraulic actuator 101 in FIG. 1 specifically includes a winch motor and a derricking cylinder to achieve recovering and utilizing of the winching energy and/or derricking energy of the crane.

The structure of the system for recovering and utilizing the crane operating energy illustrated by FIG. 6 is a combination of the system for recovering and utilizing energy of the derricking cylinder of the crane in FIG. 2 and the system for recovering and utilizing energy of the winch motor of the crane in FIG. 5. In other words, the system for recovering and utilizing crane operating energy in FIG. 6 comprises a subsystem for recovering and utilizing energy of a derricking cylinder of the crane and a subsystem for recovering and utilizing energy of a winch motor of the crane.

The system for recovering and utilizing energy of winch motor of the crane in FIG. 5 and the subsystem for recovering and utilizing energy of the winch motor of the crane are composed in parallel by an open system (an open pump control motor loop composed by a main pump 6 and a winch motor 21) and a close system (a close pump control motor energy recovery loop composed by a first hydraulic power mechanism 2 and a winch motor 21). When a winching lifting process is performed, the open system is adopted for driving; when the load is lowered, if the condition of energy recovery is met, the close system is adopted to perform energy recovery, otherwise, the open system is still adopted for controlling the lowering of the load.

The system for recovering and utilizing energy of the derricking cylinder of the crane in FIG. 2 and the subsystem for recovering and utilizing energy of the derricking cylinder of the crane in FIG. 6 are composed in parallel by an open system (an open pump control cylinder loop composed by a main pump 6 and a derricking cylinder 1) and a pump control cylinder speed adjustment system (an open pump control cylinder energy recovery loop composed by the first hydraulic power means 2 and the derricking cylinder 1); when a derricking lifting operation is performed, the open system is adopted for driving, and oil is supplied by the main pump; when a derricking lowering operation is performed, if the condition of energy recovery is met, the pump control cylinder speed adjustment system is adopted to perform energy recovery, otherwise, the open system is still adopted for controlling the lowering process of the load.

Specifically, a derricking cylinder energy recovery and reusing assembly is added in the system for recovering and utilizing crane operating energy of the embodiment in FIG. 6 on a basis of the embodiment of FIG. 5, wherein, the derricking cylinder energy recovery and reusing assembly includes a derricking cylinder 1, a derricking balance valve 10, a third main selector valve 33, a pilot oil source, a first selector valve 11, a second selector valve 13, a first cartridge 12 and a shuttle valve 14, a cartridge valve 34 and a selector valve 35.

The only difference between the derricking cylinder energy recovery and reusing assembly in FIG. 6 and the derricking cylinder energy recovering and utilizing and reusing assembly in FIG. 2 is: the first main selector valve 9 is replaced with a third main selector valve 33, and a cartridge valve 34 and a selector valve 35 are added.

Specifically, the function of the third main selector valve 33 is the same as that of the first main selector valve 9, both for switching between lifting and lowering in a derricking manner. A cartridge valve 34 and a selector valve 35 are added at the oil outlet of the first hydraulic power means 2 for the purpose of controlling the ON and OFF of the open pump control cylinder energy recovery loop to facilitate switching between the open pump control cylinder energy recovery loop and the close pump control motor energy recovery loop.

In the third embodiment of the present invention, regarding the configuration of the energy recovery loop, the first hydraulic power means 2 and a winch motor forms a close pump control motor energy recovery loop; meanwhile, the first hydraulic power means 2 and a derricking cylinder also form an open pump control cylinder energy recovery loop.

Therefore, during energy recovery, the system for recovering and utilizing crane operating energy in the third embodiment of the present invention can achieve recovery of both winching energy and derricking energy at the same time by controlling energizing/de-energizing of electromagnet valves; and may also recover winching energy or derricking energy alone.

1. Recovering winching energy alone.

During the process of lowering a sling load of the lifting system: when the sling load is lowered, electromagnets 11Y, 10Y, 3Y, 8Y and 9Y are energized, and the winch motor 21 and the first hydraulic power means form a close pump control motor loop, if the condition of energy recovery is met.

Electromagnets 11Y, 10Y are energized, then the cartridge 22 and 25 will be opened, and the first hydraulic power means 2 and the winch motor form a passage to recover the winch potential energy. The winching potential energy turns into hydraulic energy after passing a drum, a winching reducer and a winch motor, and passes the cartridge valve 22 to drive the first hydraulic power means 2 to rotate, thereby to convert hydraulic energy into mechanical energy of the transmission shaft. The mechanical energy of the transmission shaft will drive the main pump 6, the transfer case 3 and the second hydraulic power means 4 to rotate, thereby to convert the mechanical energy of the transmission shaft into rotational kinetic energy of the second hydraulic power means 4. And then the second hydraulic power means 4 will rotate accordingly.

3Y is energized to make the cartridge valve 16 closed, then the second hydraulic power means 4 fills hydraulic oil into the accumulator, i.e., finishes conversion from mechanical energy to hydraulic energy, and finally achieves recovery of winching energy. At this time, a clutch 18 of the engine may be in an open or close state, which is mainly decided by torque balance of the system during energy recovery.

8Y is energized to maintain the balance valve 30 in a close state to ensure that the potential energy of the load is not subjected to throttling loss from the balance valve, but is recovered by the first hydraulic power means 2. Meanwhile, 9Y is energized to ensure that return oil of the first hydraulic power means 2 is replenished into the low-pressure chamber of the winch motor in time.

At this time, control ends 5Y and 6Y of the second main selector valve 32 are not energized; the second main selector valve 32 is in a middle position state; the main pump is in a lower-pressure relief state; and the main oil path does not participate in energy recovery.

The energy recovery adopts a control strategy of a constant torque, that is, to ensure a reasonable distribution of a load torque, a recovery torque and a braking torque of the engine. The controller obtains, by calculation, a load torque output by the first hydraulic power means 2 to the shaft of the transfer case according to the parameters of pressure and flow, etc.; and obtains, by calculation, a recovery torque of the current energy recovery unit according to the pressure of the accumulator detected by the pressure sensor 81 and the displacement of the second hydraulic power means 4; and by judging, in real time, the relationship between the load torque and the recovery torque, the working state of the engine can be determined (i.e., to determine whether it provides a driving torque or a braking torque).

2. Recovering derricking energy alone.

During the process of derricking lowering: electromagnets 4Y, 1Y, 3Y and 12Y are energized, and the derricking cylinder and the first hydraulic power means 2 form a pump control cylinder loop. The gravitational potential energy of the derricking mechanism is converted into hydraulic energy to drive, through the cartridge 12, the first hydraulic power means 2 to rotate, thereby to convert the hydraulic energy into rotational kinetic energy of the first hydraulic power means 2; then the first hydraulic power means 2 drives the transmission shaft to rotate thereby driving the main pump 6 and the second hydraulic power means 4 to rotate accordingly, to achieve energy transfer; finally, the second hydraulic power means 4 converts the mechanical energy into hydraulic energy and stores the hydraulic energy in the accumulator, thereby to recover the potential energy of the derricking mechanism. In the whole derricking lowering process, the speed of derricking lowering is adjusted by changing the displacement of the first hydraulic power means 2 to avoid a fast derricking lowering.

As the lifted load falls and the process of energy recovery continues, the pressure of the accumulator is increased continuously, and when the pressure of the accumulator reaches a maximum working pressure which is preset for the accumulator, the displacement control signal of the second hydraulic power means 4 is set to be zero, and the electromagnet 3Y is de-energized, and the clutch 17 is turned off to perform braking entirely depending on the engine.

3. Recovering the winching energy and the derricking energy simultaneously.

According to the two circumstances mentioned above (a circumstance of recovering winching energy alone and a circumstance of recovering derricking energy alone), the gravitational potential energy generated by the crane arm and the load during the winching lowering process and the derricking lowering process can be recovered simultaneously. For detailed description, please refer to the two circumstances as mentioned above.

Regarding the configuration of the energy utilizing circuitry in the third embodiment of the present invention, the main pump 6 and the winch motor form an open pump control motor energy utilizing loop; meanwhile, the first hydraulic power means 2 and the derricking cylinder form an open pump control cylinder energy utilizing loop.

Therefore, for the system for recovering and utilizing crane operating energy in the third embodiment of the present invention, when reusing energy, the system may control energizing and de-energizing of the electromagnets valve to make the output energy of the accumulator drive the winch motor to lift the load and drive the derricking cylinder to perform a derricking lifting operation simultaneously; and may also make the output energy of the accumulator only drive the winch motor to hoist the load or only drive the derricking cylinder to perform a derricking lifting operation.

1. Applying energy of the accumulator to the winching lifting operation only.

During the process of lifting a sling load by the lifting system: when the sling load is lifted, an open system is adopted for controlling, i.e., electromagnets 11Y and 10Y are not energized; the cartridge valves 22 and 25 are turned off; and a circuitry of the first hydraulic power means 2 and the winch motor 21 is cut off. Meanwhile, the electromagnet 7Y is energized, and the main pump and the winch motor form an open pump control system to perform controlling of the winching lifting operation.

When the sling load is lifted, the driving force of the main pump may be provided by the engine and the energy recovery unit, and it is also necessary to determine the relationship between the load torque and the driving torque of the energy recovery unit. When the driving torque of the energy recovery unit is greater than the load torque, the driving force is provided by the energy recovery unit alone; at this time, electromagnet 3Y is energized, and the high-pressurized oil of the accumulator is released, to drive the second hydraulic power means 4 to rotate and convert the hydraulic energy into rotational kinetic energy of the output shaft of the variable pump/motor, thereby to drive the whole transmission shaft to rotate to finally drive the main pump to operate to achieve conversion from the stored hydraulic energy into mechanical energy. As the driving torque capable of being provided by the energy recovery unit decreases gradually, the engine can be controlled to participate in providing the driving torque, so that: electromagnet 3Y is de-energized when the accumulator cannot perform energy supply; the energy recovery unit will not provide a driving torque or only provide a small part of driving torque if the driving torque of the energy recovery unit is not sufficient to drive the load torque, and the rest of the driving torque is provided by the engine.

2. Applying energy of the accumulator to the derrick lifting operation only.

During the process of derricking lifting: electromagnets 3Y and 13Y are energized, and the derricking system is implemented by an open pump control cylinder loop composed by a main pump 6 and a derricking cylinder 1. High-pressurized oil in the accumulator drives, through the cartridge valve 16, the second hydraulic power means 4 to rotate, and the second hydraulic power means 4 drives, through a clutch 17, the transfer case to rotate, thereby to transfer mechanical energy to the transmission shaft, and thus to provide a driving force to the transmission shaft in cooperation with the engine, so as to achieve reuse of the stored hydraulic energy. At this time, for lifting of the derricking cylinder, hydraulic oil can be provided by the main pump or the second hydraulic power means, both of which belong to scope of protection of the present patent application.

As the lifted load rises, high-pressurized oil in the accumulator is released, and the pressure of the accumulator decreases continuously; when the pressure of the accumulator is higher than a certain preset value of the inflation pressure of the accumulator, the displacement control signal of the second hydraulic power means 4 is set to be zero, and the electromagnet 3Y is de-energized, and the clutch 17 is turned off, to provide power entirely depending on the engine.

3. Applying energy of the accumulator to derricking lifting and winching lifting simultaneously.

According to the two circumstances mentioned above (a circumstance of applying energy of the accumulator to derricking lifting alone and a circumstance of applying energy of the accumulator to winching lifting alone), when electromagnets 7Y, 13Y and 3Y are energized simultaneously, the energy of the accumulator can be used for derricking lifting and winching lifting at the same time. For detailed description, please refer to the two circumstances as mentioned above.

Of course, the stored energy of the accumulator can also be used for driving other mechanisms needing energy such as a rotary motor, etc.

The system for recovering and utilizing crane operating energy provided by the above embodiment of the present invention can effectively recover gravitational potential energy of the process of lifting and/or lowering the load in derricking operation, and can reuse the recovered energy for driving in a winching and/or derricking manner, which reduces fuel consumption, saves energy and reduces emission in crane operations. Moreover, in the process of lowering the load, a variable pump is adopted to adjust the speed of lowering the load, in replace of the current way of speed adjustment by a balance valve. Namely, volume speed governing replaces throttle speed governing, which reduces the amount of heat generated by the system, lengthens the service life of hydraulic components and reduces the power of the crane cooling system.

In one embodiment of the present invention, the system for recovering and utilizing the crane operating energy in FIG. 6 also includes the first torque acquisition module 201, the second torque acquisition module 202, the first discrimination module 203 and the second displacement adjustment module 204 in FIG. 3; and the third torque acquisition module 301, the fourth torque acquisition module 302 and the second discrimination module 303 in FIG. 4, as well as the third displacement adjustment module mentioned in the first and second embodiments of the present invention. The functions of these modules and connection relationship between them are the same as those in the first and second embodiments of the present invention. Further description is omitted.

In the embodiment of FIG. 6 of the present invention, the derricking cylinder 1 and the first hydraulic power means 2 form an open pump control cylinder loop to convert gravitational potential energy generated by the load and the crane arm in the derricking lowering process of the crane arm into mechanical energy of the first hydraulic power means 2; the first hydraulic power means 2 and the winch motor 21 form a close pump control motor loop to convert potential energy of the load in the winching lowering process into mechanical energy.

In one embodiment of the present invention, the derricking cylinder 1 and the first hydraulic power means 2 may also form a close pump control cylinder loop to convert gravitational potential energy generated by the sling load and the crane arm in the derricking lowering process of the crane arm into mechanical energy of the first hydraulic power means 2.

In one embodiment of the present invention, the first hydraulic power means 2 and the winch motor 21 may also form an open pump control motor loop to convert potential energy of the load into mechanical energy, which may also achieve recovery of winching energy.

According to another aspect of the present invention, a crane is provided, which includes a system for recovering and utilizing crane operating energy in any of the above embodiments.

The crane provided by the above embodiment of the present invention can effectively recover gravitational potential energy of the process of lifting and/or lowering the load in derricking operation, and can reuse the recovered energy for driving in a winching and/or derricking manner, which reduces fuel consumption, saves energy and reduces emission in crane operations. Moreover, in the lowering process of the load, a variable pump is adopted to adjust the lowering speed of the load, in replace of the current way of speed adjustment by a balance valve. Namely, volume speed governing replaces throttle speed governing, which reduces the amount of heat generated by the system, lengthens the service life of hydraulic components and reduces the power of the crane cooling system.

Figure 7:
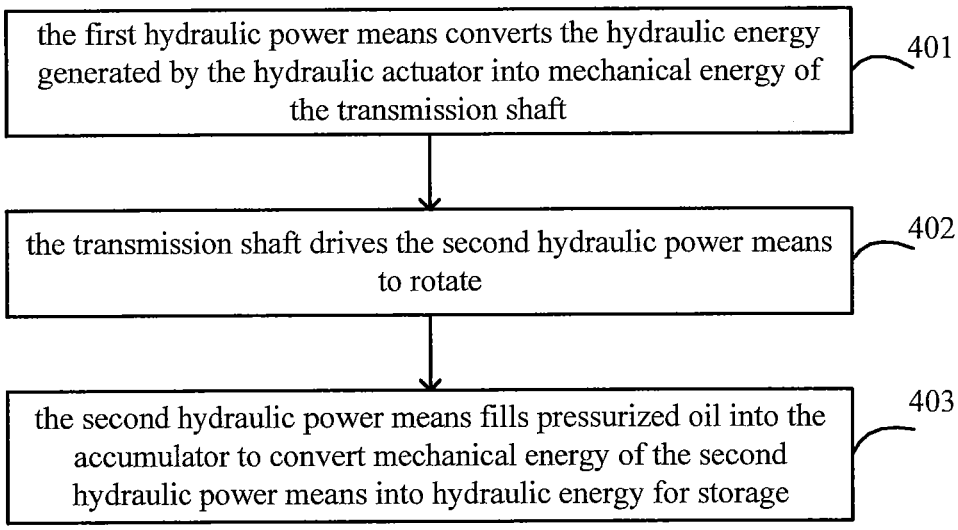
FIG. 7 is a schematic diagram of a first embodiment of a method for recovering and utilizing crane operating energy in the present invention.

FIG. 7 is a schematic diagram of a first embodiment of the method for recovering and utilizing crane operating energy in the present invention. Preferably, this embodiment may be carried out by a system for recovering and utilizing crane operating energy in any of the embodiments of FIGS. 2-6. The method comprises the following steps:

Step 401 at which the first hydraulic power means converts the hydraulic energy generated by the hydraulic actuator into mechanical energy of the transmission shaft;

Step 402 at which the transmission shaft drives the second hydraulic power means to rotate to convert mechanical energy of the transmission shaft into mechanical energy of the second hydraulic power means; and Step 403 at which the second hydraulic power means fills pressurized oil into the accumulator to convert mechanical energy of the second hydraulic power means into hydraulic energy for storage.

Preferably, the hydraulic actuator includes a hydraulic motor and/or a hydraulic cylinder, wherein the hydraulic motor generates hydraulic energy when the load is lowered, and the hydraulic cylinder generates hydraulic energy during the lowering process.

Based on the method of recovering and utilizing crane operating energy provided in the above embodiment of the present invention, energy released by the hydraulic actuator during the lowering process is recovered, which achieves the purposes of saving energy, reducing emission and reducing the amount of heat generated by the system.

Figure 8:
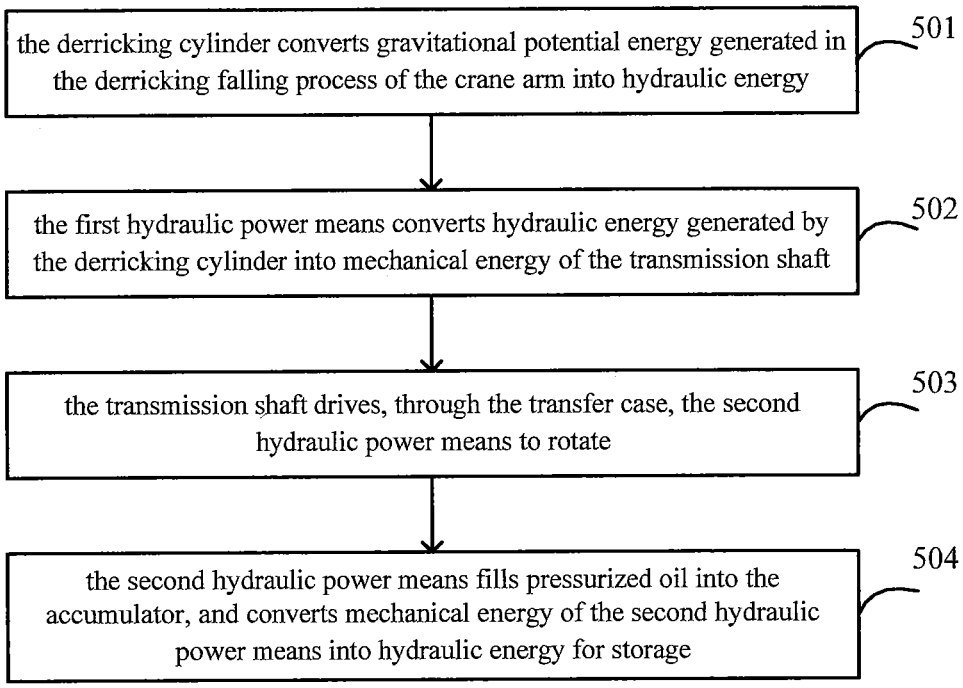
FIG. 8 is a schematic diagram of a second embodiment of a method for recovering and utilizing crane operating energy in the present invention.

FIG. 8 is a schematic diagram of a second embodiment of a method for recovering and utilizing crane operating energy of the present invention. Preferably, this embodiment can be carried out by the system for recovering and utilizing crane derricking energy in FIG. 2 or FIG. 6 of the present invention. The method comprises the following steps:

Step 501 at which the derricking cylinder 1 converts gravitational potential energy generated by the sling load and the crane arm in the derricking lowering process of the crane arm into hydraulic energy;

Step 502 at which the first hydraulic power means 2 converts the hydraulic energy generated by the derricking cylinder 1 into mechanical energy of the transmission shaft, wherein the first hydraulic power means 2 and the main pump 6 are communicated coaxially;

Step 503 at which the transmission shaft drives, through the transfer case 3, the second hydraulic power means 4 to rotate, and converts mechanical energy of the transmission shaft into mechanical energy of the second hydraulic power means, wherein the transfer case 3 is communicated with an output shaft of the engine 7, and the engine 7 is connected in parallel to the second hydraulic power means 4 via the transfer case 3; and Step 504 at which the second hydraulic power means 4 fills pressurized oil into the accumulator 5, and converts mechanical energy of the second hydraulic power means 4 into hydraulic energy for storage.

The method for recovering and utilizing crane operating energy provided in the aforementioned embodiment of the present invention can effectively recover the energy generated in the process of lowering the sling load and the crane arm in a derricking operation, and then reuses the energy, thereby to reduce fuel consumption, save energy and reduce emission in crane operations.

In one embodiment of the present invention, the method may also include: adjusting the displacement of the first hydraulic power means 2 in the derricking lowering process of the crane arm to control the speed of derricking lowering of the crane arm.

In the aforementioned embodiment of the present invention, in the lowering process of the load, a variable pump is adopted to adjust the lowering speed of the load, in replace of the current way of speed adjustment by a balance valve, i.e., volume speed governing replaces throttle speed governing, which reduces the amount of heat generated by the system, lengthens the service life of hydraulic components and reduces the power of the crane cooling system.

Figure 9:
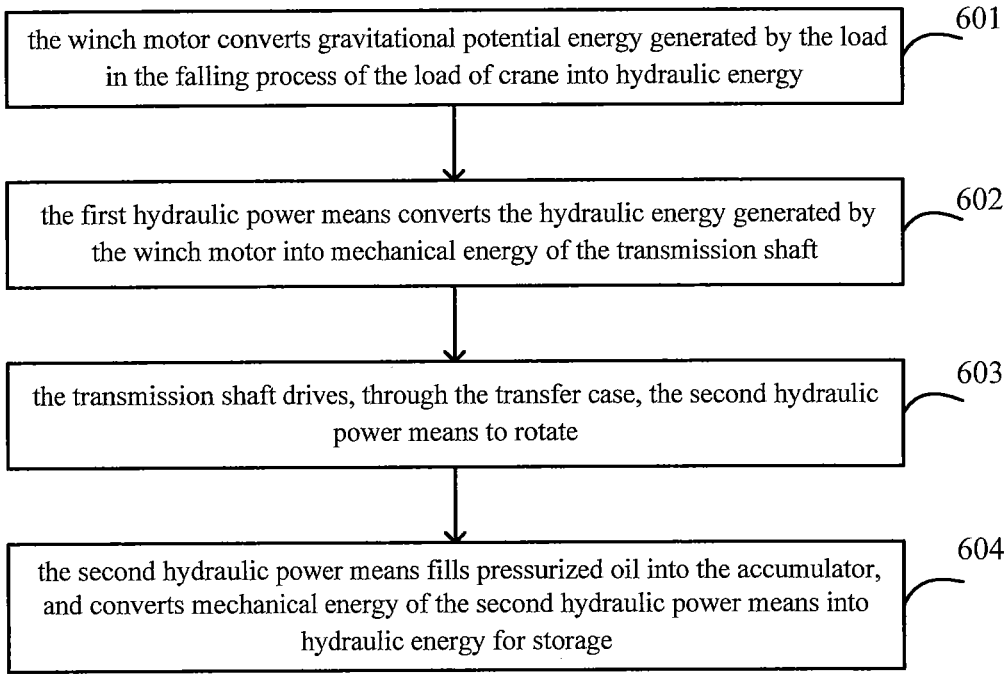
FIG. 9 is a schematic diagram of a third embodiment of a method for recovering and utilizing crane operating energy in the present invention.

FIG. 9 is a schematic diagram of a third embodiment of the method for recovering and utilizing crane operating energy in the present invention. Preferably, this embodiment can be carried out by the system for recovering and utilizing crane operating energy in FIG. 5 or FIG. 6. The method comprises the following steps:

Step 601 at which the winch motor converts gravitational potential energy generated by the sling load in the lowering process of the sling load of crane into hydraulic energy;

Step 602 at which the first hydraulic power means 2 converts the hydraulic energy generated by the winch motor 1 into mechanical energy of the transmission shaft, wherein the first hydraulic power means 2 is coaxially communicated with the main pump 6;

Step 603 at which the transmission shaft drives, through the transfer case 4, the second hydraulic power means 4 to rotate, and converts mechanical energy of the transfer case into mechanical energy of the second hydraulic power means, wherein the transfer case 3 is communicated with an output shaft of the engine 7, and the transfer 7 is connected in parallel to the second hydraulic power means 4 via the transfer case 3; and Step 604 at which the second hydraulic power means 4 fills pressurized oil into the accumulator 5, and converts mechanical energy of the second hydraulic power means 4 into hydraulic energy for storage.

Preferably, the winch motor 1 and the first hydraulic power means form a close pump control loop to convert gravitational potential energy generated by the sling load of the crane in the lowering process into hydraulic energy.

On a basis of the method for recovering and utilizing crane operating energy provided by the aforementioned embodiment of the present invention, in the process that the load of the lifting system is lowered, the winch motor and the first hydraulic power means form a close pump control system, and the first hydraulic power means drives the second hydraulic power means to fill pressurized oil into the accumulator, so as to recover the energy generated in the lowering process of the load, thus, the energy generated in the lowering process of the load in the lifting operation of the crane can be effectively recovered and then reused, which reduces fuel consumption, saves energy and reduces emission in the crane operation.

In one embodiment of the present invention, the method may also comprise: adjusting the displacement of the first hydraulic power means in the lowering process of the load so as to control the lowering speed of the load.

In the aforementioned embodiment of the present invention, in the process of lowering the load, a variable pump is adopted to adjust the speed of lowering the load, in replace of the current way of speed adjustment by a balance valve. This reduces the amount of heat generated by the system, lengthens the service life of hydraulic components and reduces the power of the crane cooling system.

Figure 10:
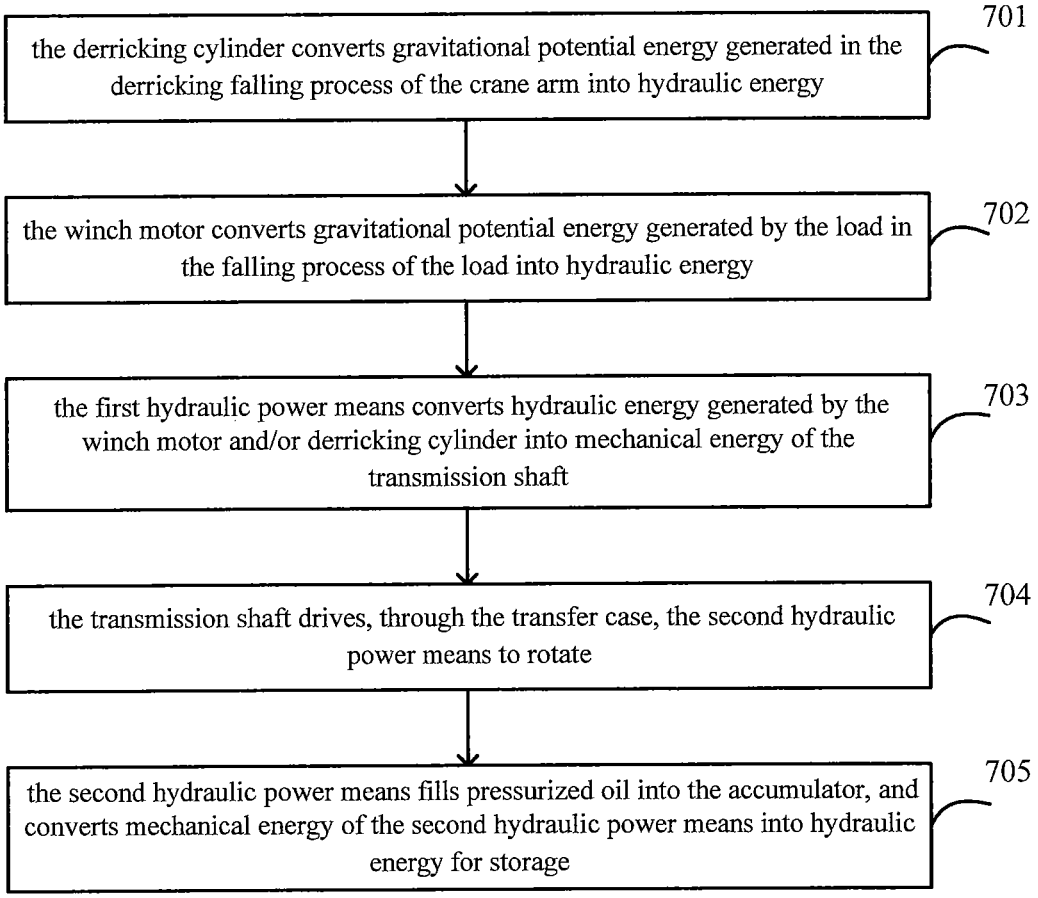
FIG. 10 is a schematic diagram of a fourth embodiment of a method for recovering and utilizing crane operating energy in the present invention.

FIG. 10 is a schematic diagram of a fourth embodiment of a method for recovering and utilizing crane operating energy in the present invention. Preferably, this embodiment is carried out by the system for recovering and utilizing crane operating energy in FIG. 6. The method comprises the following steps:

Step 701 at which the derricking cylinder 1 converts gravitational potential energy generated by the sling load and the crane arm in the derricking lowering process of the crane arm into hydraulic energy;

Step 702 at which the winch motor converts gravitational potential energy generated by the sling load in the lowering process of the sling load into hydraulic energy;

Step 703 at which the first hydraulic power means 2 converts hydraulic energy generated by the winch motor 1 into mechanical energy of the transmission shaft, wherein the first hydraulic power means 2 is coaxially communicated with the main pump 6;

Step 704 at which the transmission shaft drives, through the transfer case 3, the second hydraulic power means 4 to rotate, and converts mechanical energy of the transmission shaft into mechanical energy of the second hydraulic power means, wherein the transfer case 3 is communicated with an output shaft of the engine 7, and the engine 7 is connected in parallel to the second hydraulic power means 4 via the transfer case 3; and Step 705 at which the second hydraulic power means 4 fills pressurized oil into the accumulator, and converts mechanical energy of the second hydraulic power means 4 into hydraulic energy for storage.

Preferably, the winch motor 1 and the first hydraulic power means form a close pump control loop, which converts gravitational potential energy generated by the load in the lowering process of the load of the crane into hydraulic energy.

Based on the method for recovering and utilizing crane operating energy provided in the aforementioned embodiment of the present invention, the gravitational potential energy generated in the process of lifting and/or lowering the load in a derricking operation can be effectively recovered, and the recovered energy can be reused for driving in a winching and/or derricking manner, which reduces fuel consumption, saves energy and reduces emission in the crane operation.

In one embodiment of the present invention, the method may also comprise: adjusting the displacement of the first hydraulic power means 2 in the process that the load falls, so as to control the lowering speed of the load; and adjusting the displacement of the first hydraulic power means 2 in the derricking lowering process of the crane arm, so as to control the speed of derricking lowering of the crane arm.

In the above embodiment of the present invention, in the lowering process of the crane arm and/or the load, a variable pump is adopted to adjust the lowering speed of the load, in replace of the current way of speed adjustment by a balance valve, i.e., volume speed governing replaces throttle speed governing, which reduces the amount of heat generated by the system, lengthens the service life of hydraulic components and reduces the power of the crane cooling system.

Figure 11:
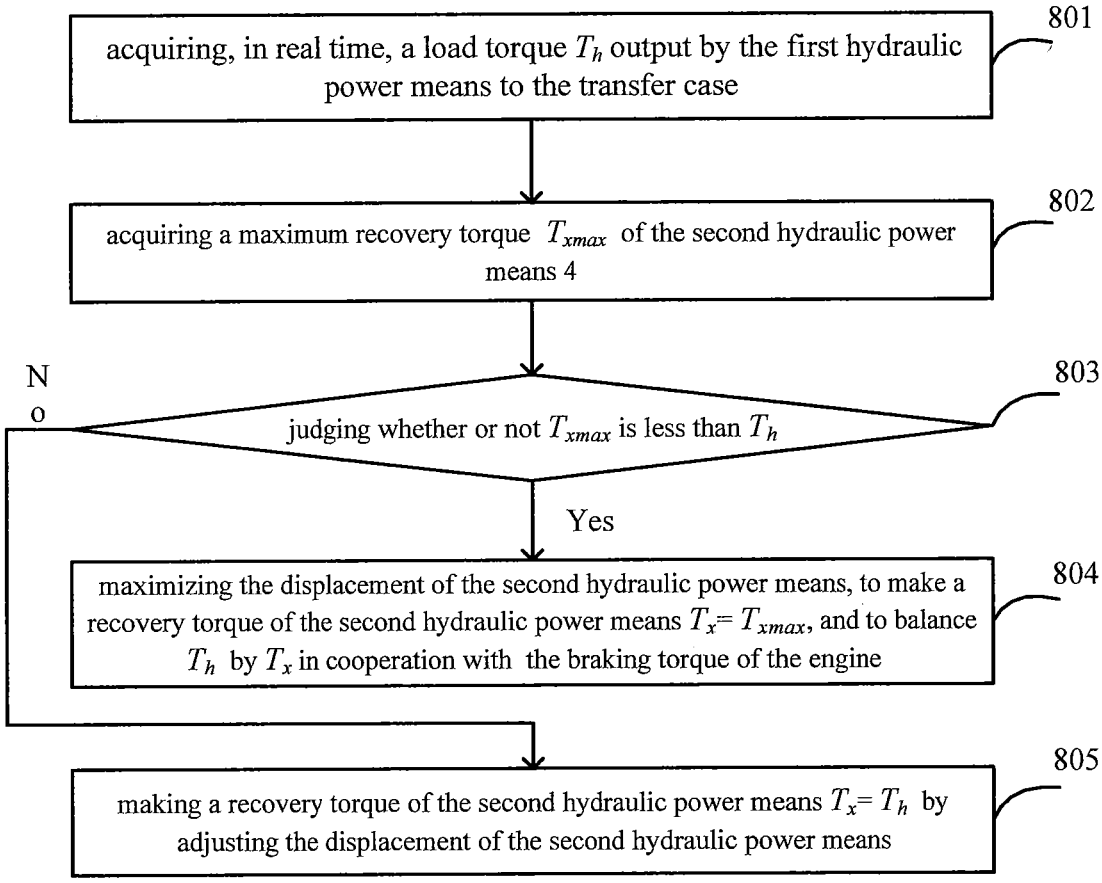
FIG. 11 is a schematic diagram of a method of adjusting a recovery torque of a second hydraulic power means in one embodiment of the present invention.

FIG. 11 is a schematic diagram of a method of adjusting a recovery torque of the second hydraulic power means in one embodiment of the present invention. In the method of recovering and utilizing crane operating energy in FIGS. 7-10, in the process that the transmission shaft drives the second hydraulic power means to rotate to convert mechanical energy of the transmission shaft into mechanical energy of the second hydraulic power means, the method also comprises:

Step 801 for acquiring, in real time, a load torque $T_h$ output by the first hydraulic power means 2 to the transfer case 3 in the derricking lowering process of the crane arm;

Step 802 for acquiring a maximum recovery torque $T_{x_{max}}$ of the second hydraulic power means 4;

Step 803 for judging whether or not $T_{x_{max}}$ is less than $T_h$. Step 804 is performed if $T_{x_{max}}$ is less than $T_h$; otherwise, step 805 is performed if $T_{x_{max}}$ is no less than $T_h$;

Step 804 for maximizing the displacement of the second hydraulic power means 4, to make a recovery torque $T_x$ of the second hydraulic power means 4 be equal to $T_{x_{max}}$, i.e., $T_x=T_{x_{max}}$, and to balance $T_h$ by $T_x$ in cooperation with the braking torque of the engine 7, and then the other steps of this embodiment will not be performed. Namely, in this circumstance, the present invention can only partially recover the mechanical energy of the first hydraulic power means 2 (i.e., partially recover the derricking energy of the derricking mechanism and/or the winching energy of the winching mechanism); and Step 805 for making a recovery torque $T_x$ of the second hydraulic power means 4 be equal to $T_h$, i.e., $T_x=T_h$, by adjusting the displacement of the second hydraulic power means 4. Namely, in this case, the present invention can recover all the mechanical energy of the first hydraulic power means 2 (i.e., recover all the derricking energy of the derricking mechanism and/or the winching energy of the winching mechanism).

The above-mentioned embodiment of the present invention adjusts a recovery torque of the second hydraulic power means by adjusting the displacement of the second hydraulic power means, so as to recover the derricking energy of the derricking mechanism and/or the winching energy of the winching mechanism as much as possible, thereby to better achieve the purpose of saving energy, reducing emission and reducing the amount of heat generated by the system.

Preferably, the embodiment of FIG. 8 may be performed by a first torque acquisition module 201, a second torque acquisition module 202, a first discrimination module 203 and a second displacement adjustment module 204 in FIG. 3.

In one embodiment of the present invention, the method may also comprise: when the pressure of the accumulator 5 reaches a preset maximum working pressure, communication between the second hydraulic power means 4 and the transfer case 3 is cut off, and $T_h$ is balanced entirely depending on a braking torque of the engine 7.

In the above-mentioned embodiment of the present invention, as the lifted load falls and the process of energy recovery continues, the pressure of the accumulator is increased continuously. When the pressure of the accumulator reaches the maximum working pressure which is preset for the accumulator, the connection between the second hydraulic power means 4 and the transfer case 3 is cut off to balance $T_h$ entirely depending on a braking torque of the engine 7.

In one embodiment of the present invention, the method also comprises: in the process that the crane performs a lifting operation, the accumulator 5 releases the stored hydraulic energy so as to provide a driving force to the hydraulic actuator of the crane.

In one embodiment of the present invention, the hydraulic actuator may include at least one of such hydraulic actuators as a derricking cylinder, a winching motor and a rotary motor, etc.

Figure 12:
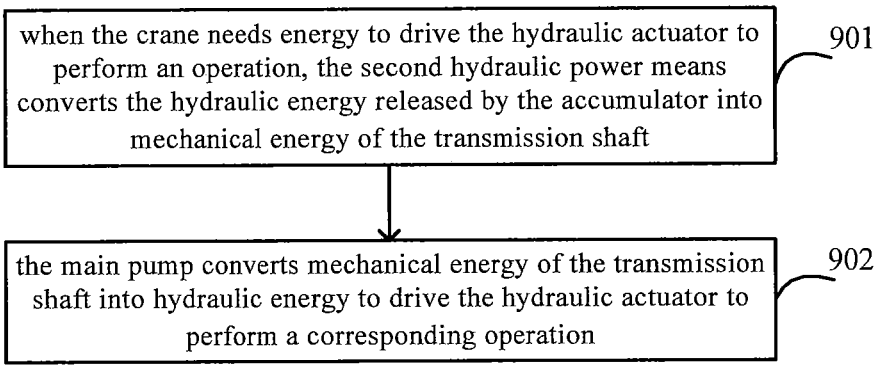
FIG. 12 is a schematic diagram of a fifth embodiment of a method for recovering and utilizing crane operating energy in the present invention.

FIG. 12 is a schematic diagram of a fifth embodiment of the method for recovering and utilizing crane operating energy of the present invention. As compared with the method of any of the embodiments in FIGS. 7-10, when the crane needs to use energy for driving a hydraulic actuator to operate, the method of FIG. 12 also comprises:

Step 901: when the crane arm is lifted in a derricking manner and there is remaining energy in the accumulator, the second hydraulic power means converts the hydraulic energy released by the accumulator into mechanical energy of the transmission shaft; and Step 902: the main pump converts mechanical energy of the transmission shaft into hydraulic energy to drive the hydraulic actuator to perform a corresponding operation.

In one embodiment of the present invention, step 902 may include: the main pump converts mechanical energy of the transmission shaft into hydraulic energy to drive the derricking cylinder to perform derricking lifting of the crane arm.

In one embodiment of the present invention, the method also comprises: adjusting the displacement of the main pump 6 in the derricking lifting process of the crane arm, so as to control the speed of derricking lifting.

In one embodiment of the present invention, the step 902 may comprise: the main pump converts mechanical energy of the transmission shaft into hydraulic energy to drive the winching motor to perform winching lifting of the load.

In one embodiment of the present invention, the method also comprises: adjusting the displacement of the main pump 6 in the winching lifting process of the load, so as to control the speed of lifting the load.

Figure 13:
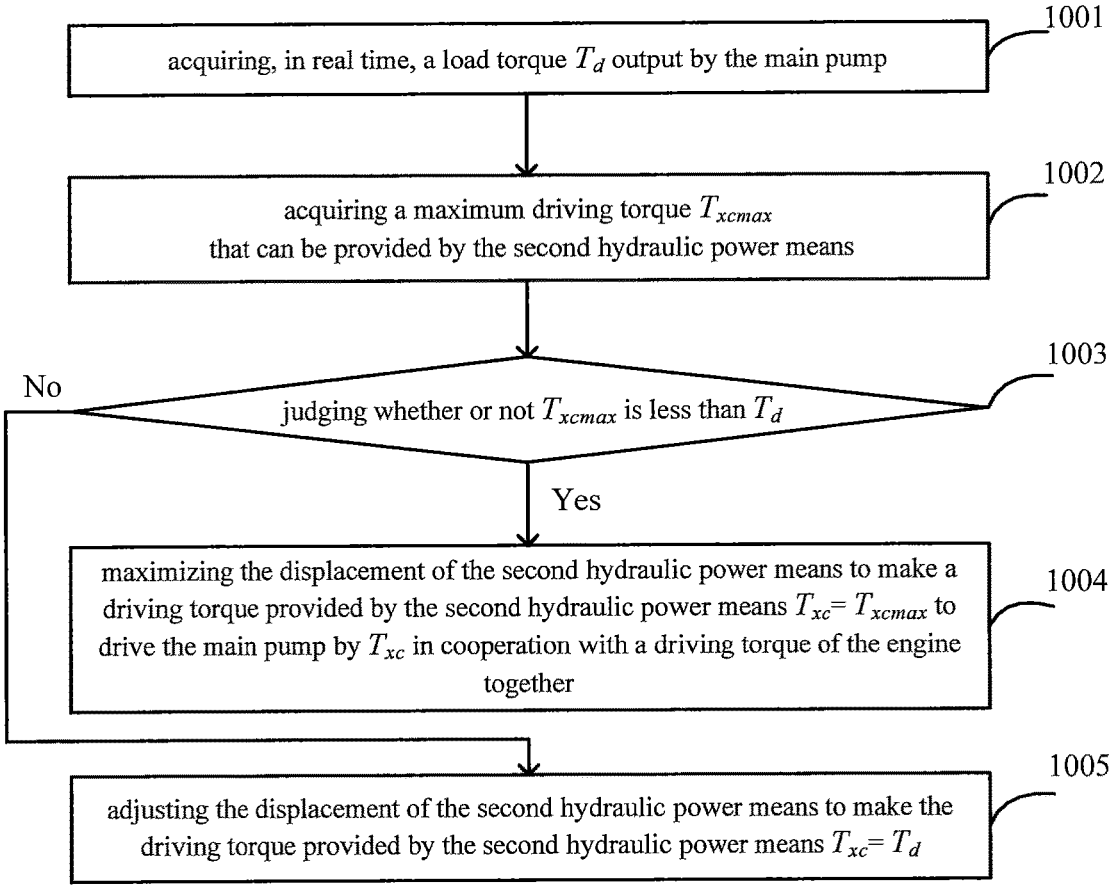
FIG. 13 is a schematic diagram of a method for adjusting a driving torque of a second hydraulic power means in one embodiment of the present invention.

FIG. 13 is a schematic diagram of a method for adjusting a driving torque of the second hydraulic power means in one embodiment of the present invention. In step 901 of the embodiment in FIG. 12, in the process that the second hydraulic power means converts the hydraulic energy released by the accumulator into mechanical energy of the transmission shaft, the method also includes:

Step 1001 for acquiring, in real time, a load torque $T_d$ output by the main pump 6;

Step 1002 for acquiring a maximum driving torque $T_{xc_{max}}$ that can be provided by the second hydraulic power means 4;

Step 1003 for judging whether or not $T_{x_{max}}$ is less than $T_d$. Step 1004 is performed if $T_{xc_{max}}$ is less than $T_d$; otherwise, step 1005 is performed if $T_{xc_{max}}$ is no less than $T_d$;

Step 1004 for maximizing the displacement of the second hydraulic power means 4 to make a driving torque $T_{xc}$ provided by the second hydraulic power means 4 be equal to $T_{xc_{max}}$, i.e., $T_{xc}=T_{xc_{max}}$, if $T_{xc_{max}}$ is less than $T_d$; and triggering the first switch 17 and the second switch 18 to be turned on so as to drive the main pump 6 by the driving torque $T_{xc}$ of the second hydraulic power means 4 in cooperation with a driving torque of the engine 7; and Step 1005: in one embodiment of the present invention, the method also comprises: adjusting the displacement of the second hydraulic power means 4, such that the driving torque $T_{xc}$ provided by the second hydraulic power means 4 is equal to $T_d$, i.e., $T_{xc}=T_d$, if $T_{xc_{max}}$ is no less than $T_d$; and triggering the first switch 17 to be turned on and triggering the second switch 18 to be turned off, that is, to drive the main pump entirely depending on the second hydraulic power means.

The above-mentioned embodiment of the present invention adjusts a driving torque of the second hydraulic power means by adjusting the displacement of the second hydraulic power means, so as to use the stored energy of the accumulator as much as possible, thereby to better achieve the purpose of saving energy, reducing emission and reducing the amount of heat generated by the system.

In one embodiment of the present invention, method may also comprise following step 901 in FIG. 12: cutting off the communication between the second hydraulic power means 4 and the transfer case 3 when the pressure of the accumulator 5 reaches a preset minimum working pressure, so as to drive the main pump 6 entirely depending on the engine 7.

In one embodiment of the present invention, as the lifted load rises, high-pressurized oil in the accumulator is released, and the pressure in the accumulator decreases continuously. When the pressure of the accumulator is higher than a preset value of the inflation pressure of the accumulator, i.e., when the pressure of the accumulator is higher than the inflation 1 MPa of the accumulator, the displacement control signal of the second hydraulic power means is set to be zero, and the electromagnet 3Y is de-energized, and the second cartridge valve 16 is turned off, and the first switch 17 is turned off, to provide a driving force entirely depending on the engine.

Preferably, the embodiment in FIG. 8 may be carried out by the third torque acquisition module 301, the fourth torque acquisition module 302, the second discrimination module 303 and the second displacement adjustment module 204 in FIG. 3.

The above-mentioned functional units, i.e., the first torque acquisition module 201, the second torque acquisition module 202, the first discrimination module 203, the second displacement adjustment module 204, the third torque acquisition module 301, the fourth torque acquisition module 302 and the second discrimination module 303, etc. are implemented as a general processor, a programmable logic controller (PLC), a digital signal processor (DSP), an application-specific integrated circuit (ASIC), a field programmable gate array (FPGA) or other programmable logic devices, discrete gate or transistor logic devices, discrete hardware assembly or any suitable combination thereof for actuating the functions described in the present application.

The functions of such functional units as the first torque acquisition module 201, the second torque acquisition module 202, the first discrimination module 203, the second displacement adjusting module 204, the third torque acquisition module 301, the fourth torque acquisition module 302 and the second discrimination module 303 as described above can be achieved by a crane controller.

So far, the present invention has been described in detail. To avoid hiding the idea of the present invention, some of the details commonly known in the art are not described. A person skilled in the art can totally understand how to implement the technical solution disclosed here according to the above description.

An ordinary person skilled in the art may understand that all or a part of the steps of the aforementioned embodiments can be completed by hardware, or completed by instructing related hardware by a program stored in a computer-readable storage medium, which may be a read-only memory, a disk or a compact disc, etc.

The description of the present invention is made for setting examples and making explanations, rather than being exhaustive or limiting the present invention to the disclosed forms. Many modifications and variations are obvious for an ordinary person skilled in the art. The selection and description of these embodiments are for the purpose of better explaining the principle and practical application of the present invention, and enabling an ordinary person skilled in the art to understand the present invention so as to design various embodiments with different modifications for particular usages.

What is claimed is:

1. A method of recovering and utilizing crane operating energy, comprising:

converting, by a first hydraulic power means, hydraulic energy generated by a hydraulic actuator into mechanical energy of a transmission shaft;

driving, by the transmission shaft, a second hydraulic power means to rotate so as to convert the mechanical energy of the transmission shaft into mechanical energy of the second hydraulic power means, further comprising:

acquiring a load torque $T_h$ output by the first hydraulic power means to a transfer case, wherein an engine and the second hydraulic power means are connected to the first hydraulic power means via the transfer case;

acquiring a maximum recovery torque $T_{x_{max}}$ of the second hydraulic power means;

judging whether or not $T_{x_{max}}$ is less than $T_h$;

maximizing a displacement of the second hydraulic power means such that a recovery torque of the second hydraulic means $T_x=T_{x_{max}}$, and balancing $T_h$ by $T_x$ in cooperation with a braking torque of the engine, if $T_{x_{max}}$ is less than $T_h$;

adjusting the displacement of the second hydraulic power means, such that the recovery torque of the second hydraulic means $T_x=T_h$, if $T_{x_{max}}$ is no less than $T_h$; and filling, by the second hydraulic power means, pressurized oil into an accumulator so as to convert the mechanical energy of the second hydraulic power means into hydraulic energy for storage.

2. The method according to claim 1, wherein the hydraulic actuator includes a derricking cylinder;

wherein the step of converting, by the first hydraulic power means, hydraulic energy generated by the hydraulic actuator into mechanical energy of the transmission shaft comprises:

converting, by the derricking cylinder, gravitational potential energy generated during derricking lowering of a crane arm into hydraulic energy; and converting, by the first hydraulic power means, the hydraulic energy generated by the derricking cylinder into mechanical energy of the transmission shaft.

3. The method according to claim 1, wherein the hydraulic actuator includes a winch motor;

wherein the step of converting, by the first hydraulic power means, hydraulic energy generated by the hydraulic actuator into mechanical energy of the transmission shaft comprises:

converting, by the winch motor, gravitational potential energy generated by a load of the crane in a lowering process of the load into hydraulic energy; and converting, by the first hydraulic power means, the hydraulic energy generated by the winch motor into mechanical energy of the transmission shaft.

4. The method according to claim 1, further comprising:

converting, by the second hydraulic power means, the hydraulic energy released by the accumulator into mechanical energy of the transmission shaft when the crane drives the hydraulic actuator to perform an operation;

converting, by a main pump, the mechanical energy of the transmission shaft into hydraulic energy in order to drive the hydraulic actuator to perform a corresponding operation.

5. The method according to claim 4, wherein the hydraulic actuator includes a derricking cylinder;

wherein the step of converting, by the main pump, the mechanical energy of the transmission shaft into hydraulic energy in order to drive the hydraulic actuator to perform the corresponding operation includes:

converting, by the main pump, the mechanical energy of the transmission shaft into hydraulic energy in order to drive the derricking cylinder to implement derricking lifting of a crane arm.

6. The method according to claim 4, wherein the hydraulic actuator includes a winch motor;

wherein the step of converting, by the main pump, the mechanical energy of the transmission shaft into hydraulic energy in order to drive the hydraulic actuator to perform the corresponding operation includes:

converting, by the main pump, the mechanical energy of the transmission shaft into hydraulic energy in order to drive the winch motor to implement winching lifting of the load.

7. The method according to claim 6, in the process of converting, by the second hydraulic power means, the hydraulic energy released by the accumulator into mechanical energy of the transmission shaft, further comprising:

acquiring a load torque $T_d$ output by the main pump;

acquiring a maximum driving torque $T_{xc_{max}}$ that can be provided by the second hydraulic power means;

judging whether or not $T_{xc_{max}}$ is less than $T_d$;

maximizing the displacement of the second hydraulic power means, such that a driving torque provided by the second hydraulic power means $T_{xc}=T_{xc_{max}}$, and driving the main pump by $T_{xc}$ in cooperation with the driving torque of the engine, if $T_{xc_{max}}$ is less than $T_d$;

adjusting the displacement of the second hydraulic power means, such that the driving torque provided by the second hydraulic power means $T_{xc}=T_d$, if $T_{xc_{max}}$ is no less than $T_d$.

8. A system for recovering and utilizing crane operating energy, comprising:

a hydraulic actuator for generating hydraulic energy;

a first hydraulic power means;

a transmission shaft;

a second hydraulic power means; and an accumulator for storing hydraulic energy, wherein the first hydraulic power means is configured to convert the hydraulic energy generated by the hydraulic actuator into mechanical energy of the transmission shaft;

the transmission shaft is configured to drive the second hydraulic power means to rotate so as to convert the mechanical energy of the transmission shaft into mechanical energy of the second hydraulic power means;

the second hydraulic power means is configured to fill the accumulator with pressurized oil so as to convert the mechanical energy of the second hydraulic power means into hydraulic energy for storage;

wherein an engine and the second hydraulic power means are connected to the first hydraulic power means via a transfer case;

the system further includes:

a first torque acquisition module configured to acquire a load torque $T_h$ output by the first hydraulic power means to the transfer case in the process that the transmission shaft drives the second hydraulic power means to rotate so as to convert the mechanical energy of the transmission shaft into mechanical energy of the second hydraulic power means;

a second torque acquisition module configured to acquire a maximum recovery torque $T_{x_{max}}$ of the second hydraulic power means in the process that the second hydraulic power means converts the hydraulic energy released by the accumulator into mechanical energy of the transmission shaft;

a first discrimination module configured to determine whether or not $T_{x_{max}}$ is less than $T_h$;

a second displacement adjustment module configured to maximize the displacement of the second hydraulic power means when $T_{x_{max}}$ is less than $T_h$ according to an output of the first discrimination module, such that a recovery torque of the second hydraulic power means $T_x=T_{x_{max}}$, and to balance $T_h$ by $T_x$ in cooperation with a braking torque of the engine; and to adjust the displacement of the second hydraulic power means to make a recovery torque of the second hydraulic power means $T_x=T_h$ when $T_{x_{max}}$ is not less than $T_h$.

9. The system according to claim 8, wherein, the hydraulic actuator includes a derricking cylinder configured to convert gravitational potential energy generated during derricking lowering of the crane arm into hydraulic energy;

the first hydraulic power means is configured to convert the hydraulic energy generated by the derricking cylinder into mechanical energy of the transmission shaft.

10. The system according to claim 8, wherein, the hydraulic actuator includes a winch motor for converting gravitational potential energy generated by a load of the crane in a lowering process of the load into hydraulic energy;

the first hydraulic power means is configured to convert the hydraulic energy generated by the winch motor into mechanical energy of the transmission shaft.

11. The system according to claim 8, wherein the accumulator is further configured to release the stored hydraulic energy when the crane drives the hydraulic actuator to perform an operation;

the second hydraulic power means is further configured to convert the hydraulic energy released by the accumulator into mechanical energy of the transmission shaft;

the system further comprises a main pump configured to convert the mechanical energy of the transmission shaft into hydraulic energy in order to drive the hydraulic actuator to perform a corresponding operation.

12. The system according to claim 11, wherein the hydraulic actuator includes a derricking cylinder configured to implement derricking lifting of a crane arm by using the hydraulic energy provided by the main pump;

the main pump is configured to convert mechanical energy of the transmission shaft into hydraulic energy and to provide the hydraulic energy to the derricking cylinder.

13. The system according to claim 11, wherein the hydraulic actuator includes a winch motor configured to implement winching lifting of the load by using the hydraulic energy provided by the main pump;

the main pump is configured to convert the mechanical energy of the transmission shaft into hydraulic energy and to provide the hydraulic energy to the winch motor.

14. The system according to claim 13, further comprising:

a third torque acquisition module configured to acquire a load torque $T_d$ output by the main pump in the process that the second hydraulic power means converts the hydraulic energy released by the accumulator into the mechanical energy of the transmission shaft;

a fourth torque acquisition module configured to acquire a maximum driving torque $T_{xc_{max}}$ that can be provided by the second hydraulic power means in the process that the second hydraulic power means converts the hydraulic energy released by the accumulator into the mechanical energy of the transmission shaft; and, a second discrimination module configured to determine whether or not $T_{xc_{max}}$ is less than $T_d$;

wherein the second displacement adjustment module is further configured to maximize the displacement of the second hydraulic power means when $T_{xc_{max}}$ is less than $T_d$ according to an output of the second discrimination module, such that the driving torque provided by the second hydraulic power means $T_{xc}=T_{xc_{max}}$, and to drive the main pump by $T_{xc}$ in cooperation with a driving torque of the engine; and to adjust the displacement of the second hydraulic power means when $T_{xc_{max}}$ is no less than $T_d$ such that the driving torque provided by the second hydraulic power means $T_{xc}=T_d$.

15. A crane including the system for recovering and utilizing crane operating energy according to claim 8.

* * * * *